US006332751B1

(12) United States Patent
Kozawa et al.

(10) Patent No.: US 6,332,751 B1
(45) Date of Patent: Dec. 25, 2001

(54) TRANSFER DEVICE CENTERING METHOD AND SUBSTRATE PROCESSING APPARATUS

(75) Inventors: Seiji Kozawa, Uto; Naruaki Iida; Jun Ookura, both of Kumamoto, all of (JP)

(73) Assignee: Tokyo Electron Limited, Tokyo (JP)

( * ) Notice: Subject to any disclaimer, the term of this patent is extended or adjusted under 35 U.S.C. 154(b) by 0 days.

(21) Appl. No.: 09/538,736

(22) Filed: Mar. 30, 2000

(30) Foreign Application Priority Data

Apr. 2, 1999 (JP) ..... 11-096046

(51) Int. Cl.[7] ..... B65H 9/00; B65H 9/20; G03D 5/00

(52) U.S. Cl. ..... 414/816; 414/222.02; 396/611; 250/206.1

(58) Field of Search ..... 250/252.1, 200, 250/201.1, 548, 206, 206.1, 206.2, 206.3, 559.36, 559.37, 559.29, 559.3, 559.33, 559.35, 559.39–559.49; 414/222.02, 816, 754; 396/611, 570, 627, 624

(56) References Cited

U.S. PATENT DOCUMENTS 4,955,780 * 9/1990 Shimane et al. .
5,054,991 * 10/1991 Kato .
5,222,293 * 6/1993 Ozimek et al. .
5,483,138 * 1/1996 Shmookler et al. .
5,511,934 * 4/1996 Bacchi et al. .
5,706,930 * 1/1998 Sahoda et al. .
5,905,850 * 5/1999 Kaveh .
5,917,601 * 6/1999 Shimazaki et al. .
5,982,132 * 11/1999 Colby .
5,982,492 * 11/1999 Oppenheimer et al. .
6,089,763 * 7/2000 Choi et al. .

FOREIGN PATENT DOCUMENTS 0 457 364-B1 * 4/1995 (EP) .
5-29436-A * 2/1993 (JP) .
5-29437-A * 2/1993 (JP) .
5-29438-A * 2/1993 (JP) .
6-124885-A * 5/1994 (JP) .

* cited by examiner

*Primary Examiner*—Charles Bowers
*Assistant Examiner*—Evan Pert
(74) *Attorney, Agent, or Firm*—Rader, Fishman & Grauer, PLLC

(57) ABSTRACT

In centering a transfer device so that tweezers of the transfer device transfer a substrate to a predetermined delivery position on a spin chuck when the substrate is delivered to a coating unit by means of the transfer device, the substrate is transferred onto the spin chuck in the coating unit by means of the tweezers, a positional deviation amount of the substrate with respect to the delivery position on the chuck is detected by a detecting device, a positional deviation amount of the tweezers is computed based on this detection value, and a position at which the tweezers deliver the substrate is corrected based on the positional deviation amount of the tweezers. Thus, centering of the substrate transfer device can be performed automatically in a short time.

16 Claims, 15 Drawing Sheets

TRANSFER DEVICE CENTERING METHOD AND SUBSTRATE PROCESSING APPARATUS

BACKGROUND OF THE INVENTION

1. Field of the Invention

The present invention relates to a transfer device centering method in a system including various kinds of processing units for performing various kinds of processing for a substrate such as a semiconductor wafer or the like and a transfer device for transferring the substrate between these processing units, and a substrate processing apparatus.

2. Description of the Related Art

In a coating and developing system in processes of semiconductor device fabrication, for example, a semiconductor wafer (hereinafter referred to as a wafer) is coated with a photoresist solution, and by means of photolithography, a circuit pattern or the like is produced and a photoresist film is exposed and developed.

The coating and developing system has a structure in which a cassette station into which a cassette housing wafers is carried and out of which the wafers are carried one by one, a processing station in which various kinds of processing units for performing various kinds of processing for coating and developing for the wafer are multi-tiered, and an interface section for transferring the wafer between an aligner provided adjacent to the processing station for exposing the wafer and the processing station are integrally connected.

In the above coating and developing system, in the cassette station, the wafers are taken out of the cassette and transferred to the processing station one by one. After being cleaned in a cleaning unit, the wafer undergoes hydrophobic processing in an adhesion unit, and it is cooled in a cooling unit and then coated with a photoresist film in a resist coating unit. Thereafter, the wafer undergoes baking processing by being heated in a baking unit.

Subsequently, the wafer is transferred from the processing station to the aligner via the interface section, and a predetermined pattern is exposed in the aligner. After being exposed, the wafer is transferred again to the processing station via the interface section. The exposed wafer undergoes baking processing (post-bake) after a developing solution is applied to thereby form the predetermined pattern in a developing unit. After a series of processing described above is completed, the wafer is transferred to the cassette station and is housed in the wafer cassette.

Incidentally, in the aforesaid series of coating and developing processing, a wafer transfer device for transferring the wafer between a plurality of processing units for performing various kinds of processing such as cleaning processing, coating processing, developing processing, baking processing, and the like is provided to be movable vertically in the processing station.

The wafer transfer device has tweezers movable horizontally, and the wafer transfer device itself is ascendable and descendable vertically (in a Z-direction) and rotatable in a θ-direction. Thus, the wafer transfer device receives and sends the wafer from/to each processing unit with the tweezers, and the wafer transfer device itself ascends and descends vertically (in the Z-direction) and rotates in the θ-direction to thereby get access to various processing units.

It is required to carry out centering for adjusting the position of tweezers in predetermined timing so that the wafer is accurately mounted on a mounting table when the wafer transfer device delivers the wafer to the mounting table in each of various processing units while the wafer is mounted on the tweezers. Namely, it is necessary to adjust a position at which the tweezers finally delivers the wafer to the mounting table after moving while the wafer is mounted thereon.

Aforesaid centering of the wafer transfer device is performed for each processing unit at the time of initialization of the coating and developing system, and also in other cases, centering of the transfer device is regularly or irregularly performed. There is, however, a demand that the aforesaid centering be performed automatically without spending much time.

SUMMARY OF THE INVENTION

An object of the present invention is to provide a transfer device centering method and a substrate processing apparatus each capable of performing centering of a substrate transfer device automatically in a short time.

To attain the aforesaid object, a first aspect of the present invention is a transfer device centering method for centering a transfer device so that the transfer device transfers a substrate to a predetermined delivery position on a mounting table in a substrate processing apparatus comprising a processing unit for performing predetermined processing for the substrate mounted on the mounting table and the transfer device for carrying the substrate into/out of the processing unit, comprising a transferring step of transferring the substrate onto a mounting table in the processing unit by means of the transfer device, a detecting step of detecting a positional deviation amount of the substrate with respect to a delivery position on the mounting table, a computing step of computing a positional deviation amount of the transfer device based on a detection value of the positional deviation amount of the substrate, and a correcting step of correcting a position at which the transfer device delivers the substrate to the mounting table of the processing unit based on the computed positional deviation amount of the transfer device.

As described above, the substrate is transferred onto the mounting table in the processing unit by means of the transfer device, a positional deviation amount of the substrate with respect to a delivery position on the mounting table is detected, a positional deviation amount of a position at which the transfer device delivers the substrate is computed based on a detection value of the positional deviation amount of the substrate, and the position at which the transfer device delivers the substrate is corrected by the obtained positional deviation amount of the transfer device, whereby centering can be performed automatically without help of an operator, thus enabling prompt centering of the transfer device, for example, at the time of initialization of the processing unit.

A second aspect of the present invention is a transfer device centering method for centering a transfer device so that the transfer device transfers a substrate to a predetermined delivery position specified by a center position of a processing plate and upper end positions of a plurality of lift pins which are raised in a substrate processing apparatus comprising a processing unit which has the processing plate with the plurality of lift pins, moves the substrate between a mounting position and a transfer position by means of the lift pins, and performs predetermined processing for the substrate at the mounting position and the transfer device for carrying the substrate into/out of the processing unit, comprising a detecting step of detecting the center position of the processing plate and the upper end positions of the plurality of raised lift pins by means of detecting means while moving the detecting means provided above the processing plate over the processing plate by the transfer device, a step of grasping a positional deviation amount of a position at which the transfer device delivers the substrate based on the detection values of the center position and the upper end positions, and a correcting step of correcting the position at which the transfer device delivers the substrate based on the positional deviation amount of the transfer device.

As described above, while the detecting means is being moved over the processing plate by the transfer device, the center position of the processing plate and the upper end positions of a plurality of lift pins which are raised are detected by the detecting means, thereafter a positional deviation amount of a position at which the transfer device delivers the substrate is grasped based on these detection values of the center position and upper end positions, and then the position at which the transfer device delivers the substrate is corrected based on the positional deviation amount of the transfer device. Accordingly, centering can be performed automatically without help of the operator, thus enabling prompt centering especially at the time of initialization of the thermal processing unit and the like.

A third aspect of the present invention is a transfer device centering method for centering a transfer device so that the transfer device transfers a substrate to a predetermined delivery position in each of processing units in a substrate processing apparatus comprising a plurality of processing units each for performing predetermined processing for the substrate and the transfer device for carrying the substrate into/out of each of the processing units, comprising a step of previously performing centering of a position at which the transfer device delivers the substrate in each processing unit and storing this centering data in storage means, a first correcting step of grasping a positional deviation amount of a position at which the transfer device delivers the substrate in one processing unit in predetermined timing and correcting the position at which the transfer device delivers the substrate based on the positional deviation amount, a replacing step of inputting correction data at this time to the storage means, and based on this correction data, replacing the centering data for each processing unit already stored in the storage means with predetermined correction data, and a second correcting step of correcting positions at which the transfer device delivers the substrate in the other processing units based on the correction data after replacement.

As described above, a positional deviation amount of a position at which the transfer device delivers the substrate in one processing unit is grasped in the predetermined timing, the position at which the transfer device delivers the substrate is corrected based on this positional deviation amount, correction data at this time is inputted to the storage means, based on this correction data, centering data for respective processing units which are already stored in the storage means are replaced with the predetermined correction data, and based on the correction data after replacement, positions at which the transfer device delivers the substrate in the other processing units are corrected. Therefore, if correction data for one processing unit can be obtained, only correction of already stored centering data needs to be performed based on this correction data in the other processing units. As a result, centering of the transfer device for a plurality of processing units can be performed in a very short time.

A fourth aspect of the present invention is a transfer device centering method for centering a transfer device so that the transfer device transfers a substrate to a predetermined delivery position in each of processing units in a substrate processing apparatus comprising at least one first processing unit for performing predetermined processing for the substrate mounted on a rotatable mounting table, at least one second processing unit which has a processing plate with a plurality of lift pins, moves the substrate between a mounting position and a transfer position by means of the lift pins, and performs predetermined processing for the substrate at the mounting position, and the transfer device for carrying the substrate into/out of the first and second processing units, comprising a step of previously performing centering of positions at which the transfer device delivers the substrate in methods different from each other in the first and second processing units and storing these centering data in storage means, a step of previously grasping a relationship between the centering data in the first processing unit and the centering data in the second processing unit and storing the relationship in the storage means, a first correcting step of grasping a positional deviation amount of a position at which the transfer device delivers the substrate in either one of the first processing unit or the second processing unit in predetermined timing and correcting the position at which the transfer device delivers the substrate based on the positional deviation amount, a replacing step of inputting correction data at this time to the storage means and based on this correction data and the relationship between the centering data in the first processing unit and the centering data in the second processing unit, replacing centering data for the other processing units previously stored in the storage means with predetermined correction data, and a second correcting step of correcting positions at which the transfer device delivers the substrate in the other processing units based on the correction data after replacement for the other processing units.

As described above, a positional deviation amount of a position at which the transfer device delivers the substrate in either one of the first processing unit or the second processing unit is grasped in the predetermined timing, the position at which the transfer device delivers the substrate is corrected based on the positional deviation amount, correction data at this time is inputted to the storage means, based on this correction data and the relationship between the centering data in the first processing unit and the centering data in the second processing unit, centering data for the other processing units previously stored in the storage means are replaced with predetermined correction data, and positions at which the transfer device delivers the substrate in the other processing units are corrected based on the correction data after replacement for the other processing units. Thereby, even when centering is performed in the first processing unit and the second processing unit in different methods, if correction data for one processing unit can be obtained, only correction of already stored centering data needs to be performed based on this correction data in the other processing units. Accordingly, centering of the transfer device for a plurality of processing units can be performed in a very short time.

A fifth aspect of the present invention is a substrate processing apparatus for performing predetermined processing for a substrate, comprising a plurality of processing units each for performing predetermined processing for the substrate, a transfer device for transferring the substrate to a predetermined delivery position in each of the processing units, and centering means for obtaining correction data for correcting a position at which the transfer device delivers the substrate in each processing unit, and based on the correction data, correcting the position at which the transfer device delivers the substrate, the centering means comprising storage means in which centering data for respective processing units are stored and controlling means for grasping a positional deviation amount of a position at which the transfer device delivers the substrate in one unit, correcting the position at which the transfer device delivers the substrate based on the positional deviation amount, inputting correction data at this time to the storage means, based on this correction data, replacing the centering data for each processing unit already stored in the storage means with predetermined correction data, and based on the correction data after replacement, correcting positions at which the transfer device delivers the substrate in the other processing units.

A sixth aspect of the present invention is a substrate processing apparatus for performing predetermined processing for a substrate, comprising at least one first processing unit for performing predetermined processing for the substrate mounted on a rotatable mounting table, at least one second processing unit which has a processing plate with a plurality of lift pins, moves the substrate between a mounting position and a transfer position by means of the lift pins, and performs predetermined processing for the substrate at the mounting position, a transfer device for transferring the substrate to/from a predetermined delivery position in each of the first and second processing units, and centering means for obtaining correction data for correcting a position at which the transfer device delivers the substrate in each of the processing units, and based on the correction data, correcting the position at which the transfer device delivers the substrate, the centering means comprising storage means in which centering data when centering of positions at which the transfer device delivers the substrate is performed in methods different from each other in the first processing unit and the second processing unit and a relationship between the centering data in the first processing unit and the centering data in the second processing unit are stored, and controlling means for grasping a positional deviation amount of a position at which the transfer device delivers the substrate in either one of the first processing unit or the second processing unit, correcting the position at which the transfer device delivers the substrate based on the positional deviation amount, inputting correction data at this time to the storage means, based on this correction data and the relationship between the centering data in the first processing unit and the centering data in the second processing unit stored in the storage means, replacing the centering data for each processing unit already stored in the storage means with predetermined correction data, and based on the correction data after replacement, correcting positions at which the transfer device delivers the substrate in the other processing units.

In the fifth and sixth aspects of the present invention, likewise with the third and fourth aspects, if correction data for one processing unit is obtained, only correction of already stored centering data needs to be performed based on this correction data in the other processing units. As a result, centering of the transfer device for a plurality of processing units can be performed in a very short time.

These objects and still other objects and advantages of the present invention will become apparent upon reading the following specification when taken in conjunction with the accompanying drawings.

DETAILED DESCRIPTION OF THE PREFERRED EMBODIMENT

Figure 1:
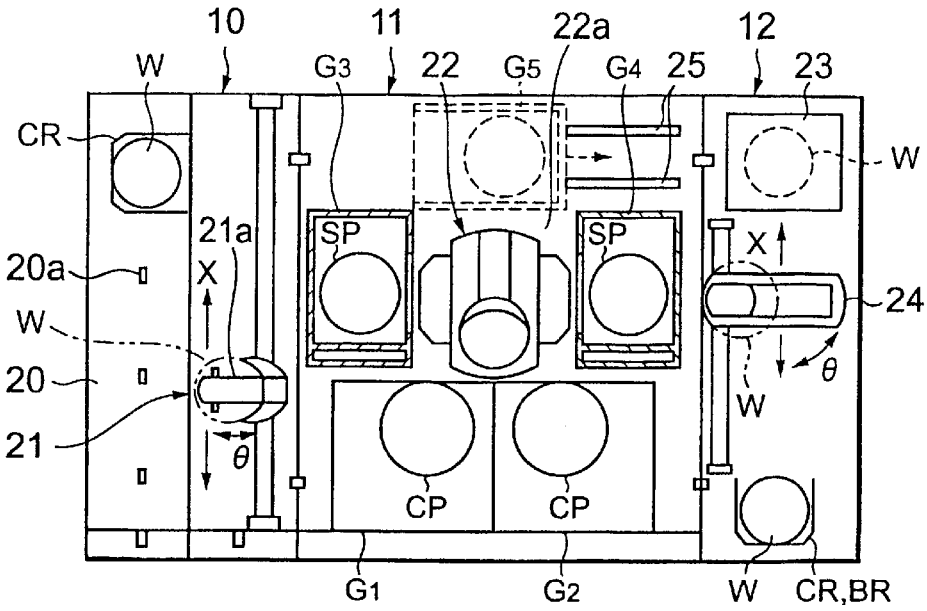
FIG. 1 is a plan view showing the entire structure of a coating and developing system for a semiconductor wafer as an embodiment of the present invention.
Figure 2:
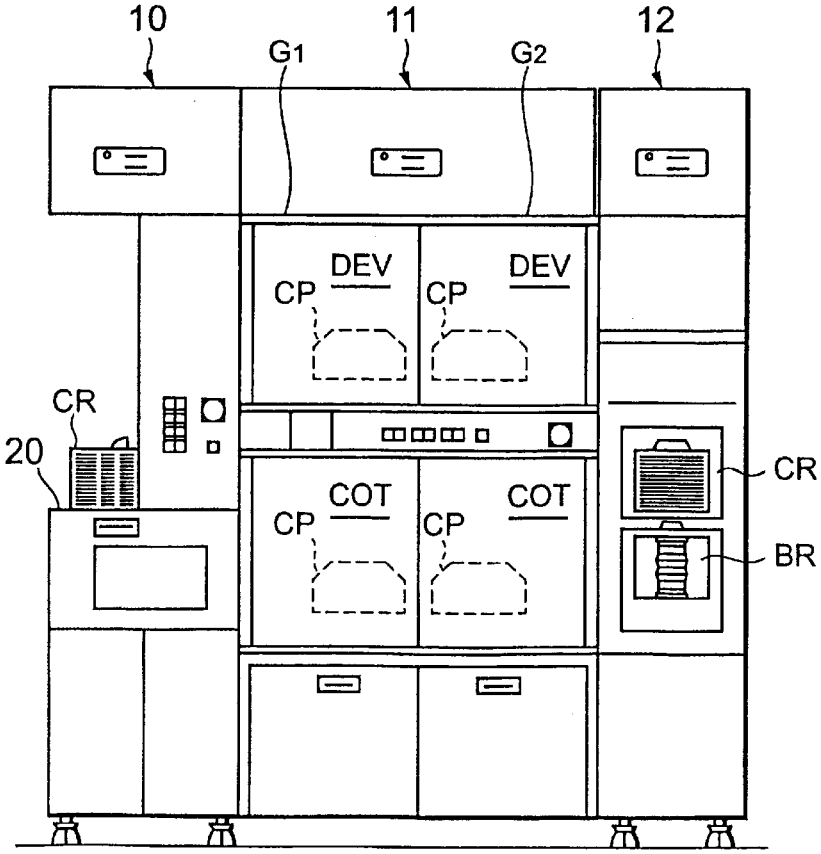
FIG. 2 is a front view showing the coating and developing system shown in FIG. 1.
Figure 3:
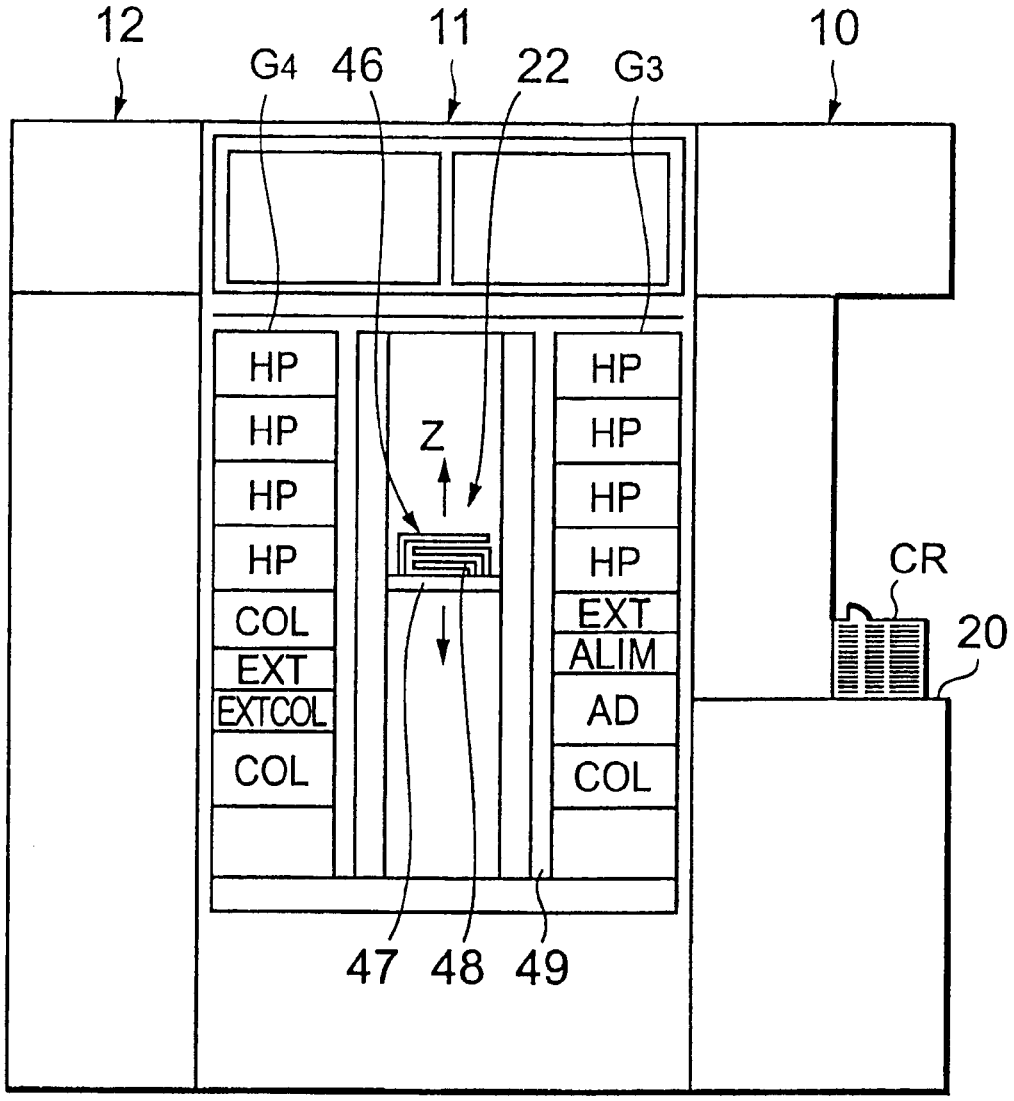
FIG. 3 is a rear view showing the coating and developing system shown in FIG. 1.

As shown in FIG. 1 to FIG. 3, a processing system includes a cassette station 10 as a transfer station, a processing station 11 having a plurality of processing units, and an interface section 12 for transferring a wafer W between the processing station 11 and an aligner (not illustrated) provided adjacent thereto.

The cassette station 10 is provided for carrying a plurality of, for example, 25 semiconductor wafers W (hereinafter referred to only as wafers) as objects to be processed, as a unit, housed in a wafer cassette CR out of/into another system into/out of this system and transferring the wafer W between the wafer cassette CR and the processing station 11.

In this cassette station 10, as shown in FIG. 1, a plurality of (four in FIG. 1) positioning projections 20*a* are formed along an X-direction in FIG. 1 on a cassette mounting table 20, and the wafer cassettes CR can be mounted in a line with respective wafer transfer ports facing the side of the processing station 11 at the positions of the projections 20*a*. In the wafer cassette CR, the wafers W are arranged in a vertical direction (Z-direction). The cassette station 10 has a wafer transfer mechanism 21 disposed between the wafer cassette mounting table 20 and the processing station 11. The wafer transfer mechanism 21 has a wafer transfer arm 21*a* movable in the direction of arrangement of the cassettes (X-direction) and in the direction of arrangement of the wafers W housed therein (Z-direction) and can selectively get access to any one of the wafer cassettes CR by the transfer arm 21*a*. The wafer transfer arm 21*a* is structured to be rotatable in a θ-direction so that it is accessible to an alignment unit (ALIM) and an extension unit (EXT) which are included in a third processing section $G_3$ on the processing station 11 side which will be described later.

The processing station 11 includes a plurality of processing units for carrying out a series of processes when coating and developing are performed for the wafer W. The plurality of processing units are multi-tiered at predetermined positions, and the wafers W are processes one by one by these units. As shown in FIG. 1, the processing station 11 has a transfer path 22*a* in the middle thereof, and a main wafer transfer mechanism 22 is provided therein. All the processing units are arranged around the wafer transfer path 22*a*. These plurality of processing units are divided into a plurality of processing sections, and a plurality of processing units are multi-tiered along tiered the vertical direction in each processing section.

As shown in FIG. 3, the main transfer mechanism 22 is provided with a wafer transfer device 46 which is ascendable and descendable vertically (in the Z-direction) inside a cylindrical supporting body 49. The cylindrical supporting body 49 can rotate by rotation driving force of a motor (not illustrated), and with the above rotation, the wafer transfer device 46 also can rotate integrally.

The wafer transfer device 46 is provided with a plurality of, for example, three holding members 48 in this embodiment which are movable in the fore-and-aft direction of a transfer base 47, and the wafer W can be transferred between respective processing units by these holding members 48.

As shown in FIG. 1, in this embodiment, four processing sections $G_1$, $G_2$, $G_3$, and $G_4$, are arranged around the wafer transfer path 22*a*, and a processing section $G_5$ can be provided as required.

Out of these processing sections, the first and second processing sections $G_1$ and $G_2$ are arranged in a row on the front side of the system {on the lower side in FIG. 1), the third processing section $G_3$ is placed adjacent to the cassette station 10, the fourth processing section $G_4$ is placed adjacent to the interface section 12. The fifth processing section $G_5$ can be provided at the rear.

In this case, as shown in FIG. 2, in the first processing section $G_1$, two spinner-type processing units in each of which the wafer W is mounted on a spin chuck (not illustrated) inside a cup CP to undergo predetermined processing are vertically two-tiered. In this embodiment, a resist coating unit (COT) for applying a resist onto the wafer W and a developing unit (DEV) for developing a pattern of the resist are two-tiered from the bottom in order. Similarly in the second processing section $G_2$, a resist coating unit (COT) and a developing unit (DEV) as two spinner-type processing units are two-tiered from the bottom in order.

The reason why the resist coating unit (COT) and the like are disposed on the lower tier side is that drainage of a resist solution is essentially more complex in terms of both mechanism and maintenance than that of a developing solution, and that the complexity is mitigated by disposing the coating unit (COT) and the like on the lower tier as described above. It is possible, however, to dispose the resist coating unit (COT) and the like on the upper tier as required.

As shown in FIG. 3, in the third processing section $G_3$, oven-type processing units in each of which the wafer W is placed on a mounting table SP to undergo predetermined processing are multi-tiered. Specifically, a cooling unit (COL) for performing cooling processing, an adhesion unit (AD) for performing so-called hydrophobic processing to enhance adhesion properties of the resist, an alignment unit (ALIM) for performing alignment, an extension unit (EXT) for carrying the wafer W in and out, and four hot plate units (HP) for performing heat processing for the wafer W before and after exposure processing and after developing processing are eight-tiered from the bottom in order. Incidentally, it is suitable that a cooling unit (COL) is provided in place of the alignment unit (ALIM) and that only the cooling unit (COL) is given an alignment function.

Also in the fourth processing section $G_4$, oven-type processing units are multi-tiered. Specifically, a cooling unit (COL), an extension and cooling unit (EXTCOL) which is a wafer transfer section provided with a cooling plate, an extension unit (EXT), a cooling unit (COL), and four hot plate units (HP) are eight-tiered from the bottom in order.

The aforesaid arrangement of the cooling unit (COT) and the extension and cooling unit (EXTCOL) having low processing temperature at the lower tiers and the hot plate units (HP) having high processing temperature at the upper tiers, can reduce thermal mutual interference between units. Random multi-tiered arrangement is naturally suitable.

The fifth processing section $G_5$ can be disposed on the rear side of the main wafer transfer mechanism 22 as described above. When the fifth processing section $G_5$ is provided, it can move along guide rails 25 laterally when viewed from the main wafer transfer mechanism 22. Therefore, even if the fifth processing section $G_5$ is provided, a space portion is made available by sliding the fifth processing section $G_5$ along the guide rails 25, thereby making it possible to easily carry out maintenance operation for the main wafer transfer mechanism 22 from the rear side. In this case, a space portion can be secured not only by the aforesaid linear movement but also by rotational movement. Incidentally, basically likewise with the third and fourth processing section $G_3$ and $G_4$, a structure in which oven-type processing units are multi-tiered can be applied to the fifth processing section $G_5$.

The aforesaid interface section 12 is the same as the processing station 11 in depth-directional (X-directional) length. As shown in FIG. 1 and FIG. 2, a transportable pickup cassette CR and a fixed buffer cassette BR are two-tiered at the front of the interface section 12, a peripheral aligner 23 is disposed at the rear thereof, and a wafer transfer body 24 is disposed at the center thereof. The wafer transfer body 24 moves in the X-direction and the Z-direction so as to be accessible to both the cassettes CR and BR, and the peripheral aligner 23. The wafer transfer body 24 is also rotatable in the θ-direction so as to be accessible to the extension unit (EXT) included in the fourth processing section $G_4$ of the processing station 11 and also to a wafer delivery table (not illustrated) on the adjacent aligner side.

In the aforesaid resist coating and developing system, first of all, in the cassette station 10, the wafer transfer arm 21*a* of the wafer transfer mechanism 21 gets access to the wafer cassette CR housing unprocessed wafers W on the cassette mounting table 20, takes one wafer W out of the cassette CR, and transfers it to the extension unit (EXT) of the third processing section $G_3$.

The wafer W is carried into the processing station 11 from the extension unit (EXT) by means of the wafer transfer device 46 of the main wafer transfer mechanism 22. After being aligned in the alignment unit (ALIM) of the third processing section $G_3$, the wafer W is transferred to the adhesion unit (AD) to undergo hydrophobic processing (HMDS processing) to enhance adhesion properties of the resist. Since this processing involves heating, the wafer W is then transferred to the cooling unit (COL) by the wafer transfer device 46 to be cooled.

The wafer W which is cooled in the cooling unit (COL) after the completion of the adhesion processing is subsequently transferred to the resist coating unit (COT) by the wafer transfer device 46, and a coating film is formed there. After undergoing coating processing, the wafer W undergoes pre-bake processing in any one of the hot plate units (HP) in the processing sections $G_3$ and $G_4$, and thereafter it is cooled in any one of the cooling units (COL).

The cooled wafer W is transferred to the alignment unit (ALIM) of the third processing section $G_3$ to be aligned, and then transferred to the interface section 12 via the extension unit (EXT) of the fourth processing section $G_4$.

After the excess resist is removed by peripheral exposure by means of the peripheral aligner 23 in the interface section 12, exposure processing is performed for the resist film of the wafer W in accordance with a predetermined pattern by means of the aligner (not illustrated) provided adjacent to the interface section 12.

The wafer W after exposure is returned again to the interface section 12, and transferred to the extension unit (EXT) included in the fourth processing section $G_4$ by the wafer transfer body 24. Thereafter, the wafer W is transferred to any one of the hot plates (HP) by the wafer transfer device 46 to undergo post-exposure bake processing and then cooled in the cooling unit (COL).

Subsequently, the wafer W is transferred to the developing unit (DEV), where developing of the exposed pattern is performed. After the completion of developing, the wafer W is transferred to any one of the hot plates (HP) to undergo post-bake processing, and then cooled in the cooling unit (COL). After the aforesaid series of processing is completed, the wafer W is returned to the cassette station 10 through the extension unit (EXT) of the third processing section $G_3$, and housed in any one of the wafer cassettes CR.

Figure 4:
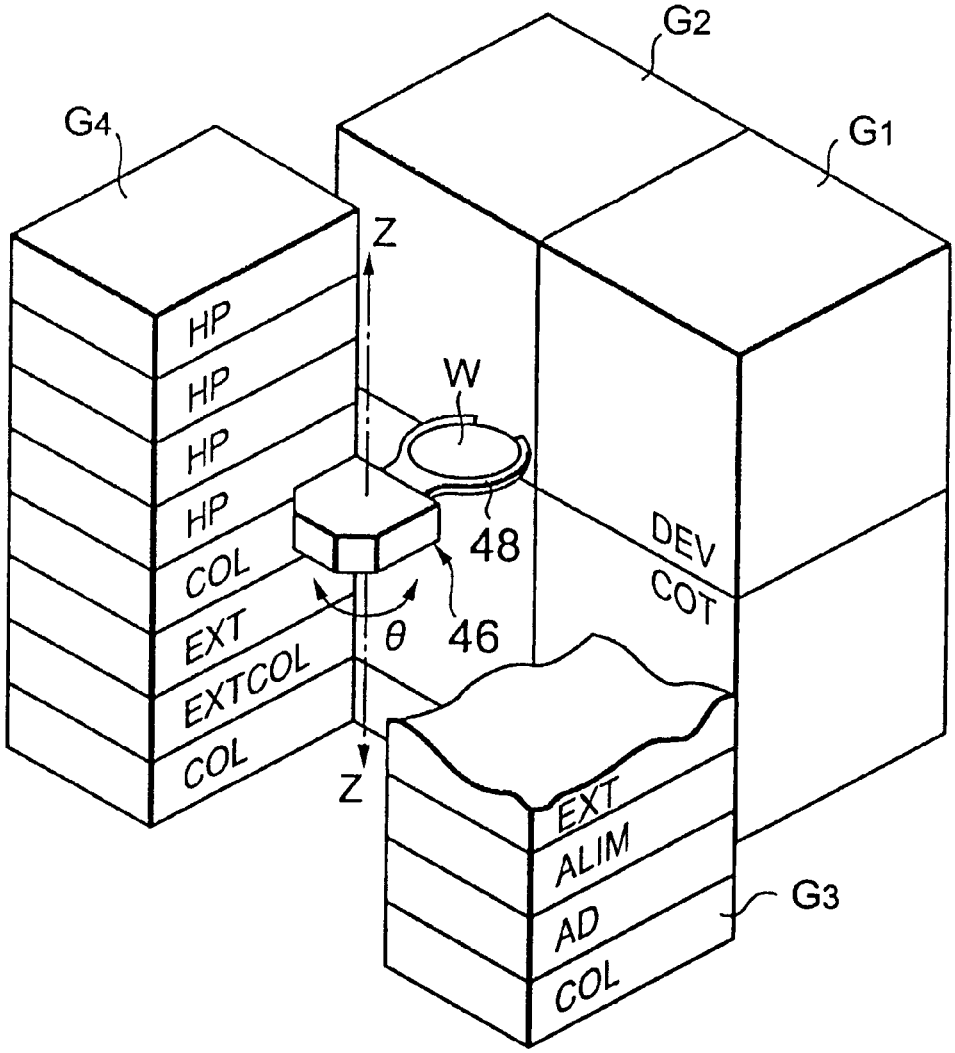
FIG. 4 is a perspective view schematically showing the inside of a processing station.
Figure 5:
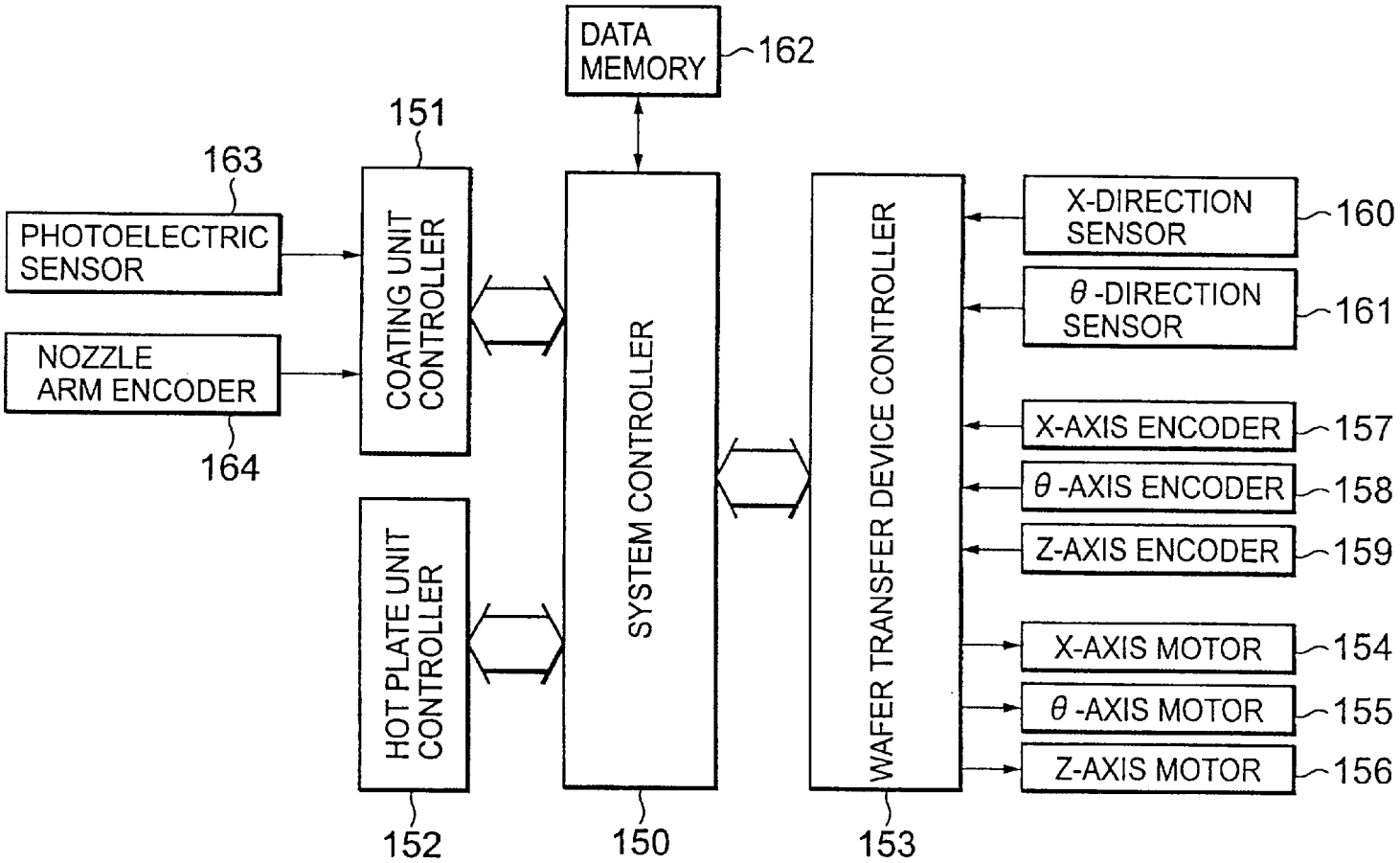
FIG. 5 is a block diagram of the coating and developing system with a transfer system as the main constituent thereof.

Next, a transfer system of the wafer W will be explained with reference to FIG. 1, FIG. 4, and FIG. 5. FIG. 4 is a perspective view schematically showing the inside of the processing station, and FIG. 5 is a block diagram of the coating and developing system with the transfer system as the main constituent thereof.

It should be noted that the X-direction is the fore-and-aft direction of each station, the Z-direction is the vertical direction in each station as shown in FIG. 4, and the θ-direction is the direction of rotation of the transfer device.

As shown in FIG. 4, the wafer transfer device 46 in the processing station 11 has tweezers 48 movable horizontally and the wafer transfer device 46 itself is ascendable and descendable in the vertical direction (Z-direction) and rotatable in the θ-direction.

Thus, the wafer transfer device 46 can receive or send the wafer W from or to each processing unit by means of the tweezers 48 and can get access to respective processing units (for example, HP, . . . and COL) in the same processing unit group (for example, the third processing section $G_3$) by ascending and descending in the vertical direction (Z-direction). Moreover, it can get access from any one processing unit (for example, COT) of one processing section (for example, the second processing section $G_2$) to any one processing unit (for example, HP) of another processing section (for example, the third processing section $G_3$) by ascending and descending in the vertical direction (Z-direction) and rotating in the θ-direction.

Further, as shown in FIG. 5, a system controller 150 for controlling the entire coating and developing system is provided. Controllers for respective processing units, for example, a coating unit controller 151, a hot plate unit controller 152, a wafer transfer device controller 153, and the like are connected to the system controller 150. Incidentally, intermediate block controllers each for controlling each processing unit group may be provided between the controllers for respective processing units and the system controller 150.

The wafer transfer device 46 is provided with an X-axis motor 154 for moving the tweezers 48, a θ-axis motor 155 for rotating the transfer device itself, and a Z-axis motor 156 for moving the transfer device itself vertically, and these motors are controlled by the transfer device controller 153. Moreover, the X-axis motor 154, the θ-axis motor 155, and the Z-axis motor 156 are provided respectively with an X-axis encoder 157, a θ-axis encoder 158, and a Z-axis encoder 159 for feeding back amounts of rotation of the respective motors (that is, an amount of movement of the tweezers 48 and amounts of rotation and movement of the transfer device 46 itself) to the system controller 150 via the transfer device controller 153.

Detection signals from an X-direction sensor 160 and a θ-direction sensor 161 of a transmission-type photoelectric sensor used for centering of the transfer device 46 in the hot plate unit (HP) are inputted to the wafer transfer device controller 153 as will be described later. Moreover, as will be described later, a data memory 162 for storing position correction data and the like at the time of centering is connected to the system controller 150. As will be described later, a detection signal from a reflection-type photoelectric sensor 163 used for centering of the transfer device 46 in the coating unit (COT) and a position data signal from a nozzle arm encoder 164 are inputted to the coating unit controller 151. Incidentally, the data memory 162 may be contained in the system controller 150.

Figure 6:
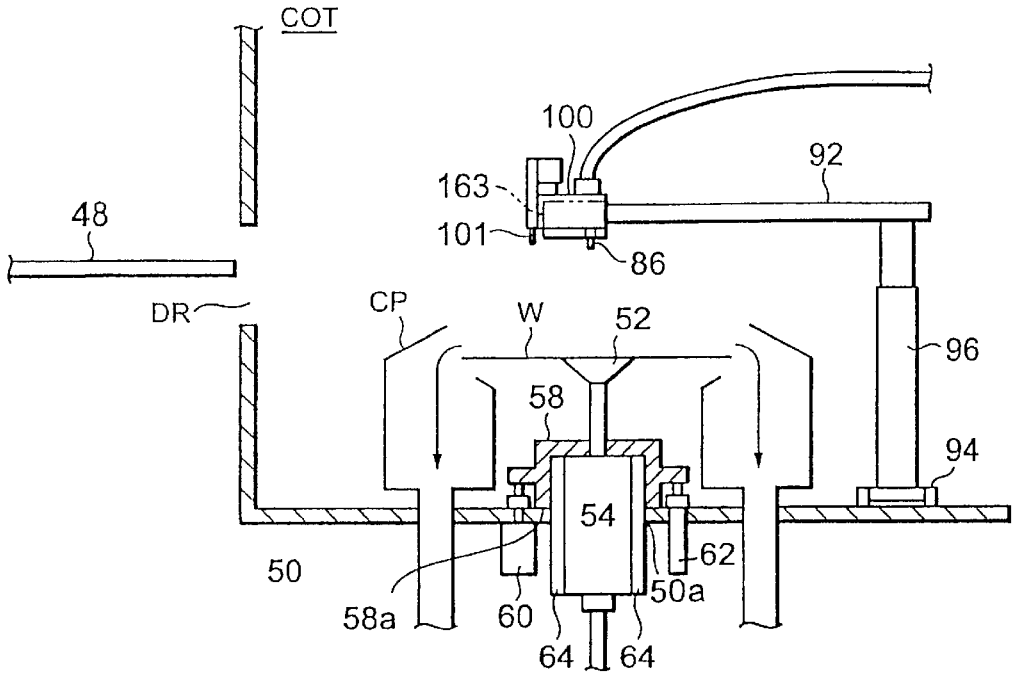
FIG. 6 is a schematic sectional view showing the entire structure of a resist coating unit (COT)
Figure 7:
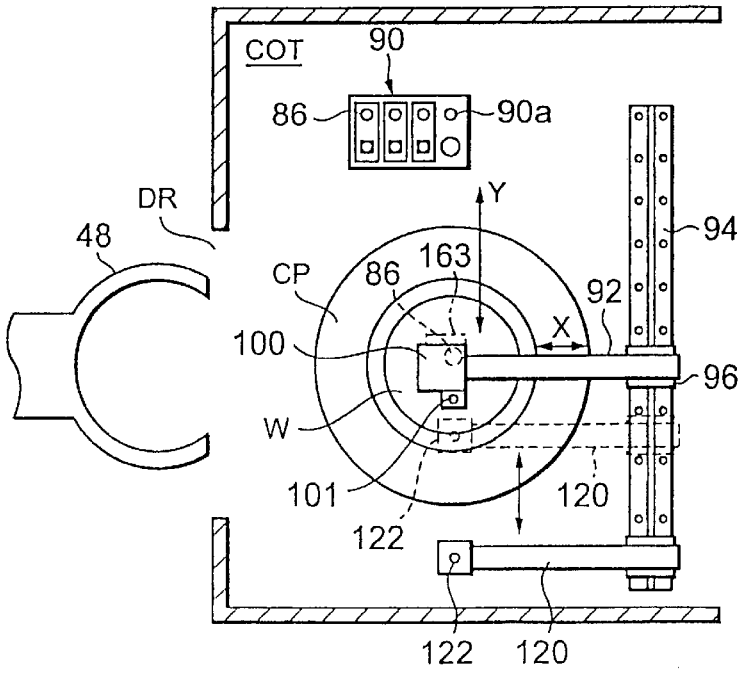
FIG. 7 is a schematic plan view showing the entire structure of the resist coating unit (COT)

Next, the resist coating unit (COT) in the present embodiment will be explained. FIG. 6 and FIG. 7 are a schematic sectional view and a schematic plan view each showing the entire structure of the resist coating unit (COT).

In the middle of the resist coating unit (COT), the annular cup CP is disposed, and a spin chuck 52 is disposed within the cup CP. The spin chuck 52 is rotationally driven by a drive motor 54 while holding the wafer W by vacuum suction. The drive motor 54 is disposed to be ascendable and descendable in an opening 50*a* provided in a unit base plate 50 and connected to raising and lowering drive means 60, for example, composed of an air cylinder and raising and lowering guide means 62 with a cap-shaped flange member 58, for example, made of aluminum therebetween. A cylinder cooling jacket 64, for example, composed of SUS, is attached to the side face of the drive motor 54, and the flange member 58 is attached so as to cover the upper half of the cooling jacket 64.

In resist coating, a lower end 58*a* of the flange member 58 is closely attached to the unit base plate 50 in the vicinity of the outer periphery of the opening 50*a,* whereby the inside of the unit is tightly shut. When the wafer W is transferred between the spin chuck 52 and the holding members 48 of the main wafer transfer mechanism 22, the lower end of the flange member 58 is lifted off the unit base plate 50 thus raising and lowering the spin chuck 55 by the raising and lowering drive mans 60.

A resist nozzle 86 for discharging a resist solution onto the front surface of the wafer W is detachably attached to a forward end portion of a resist nozzle scan arm 92 with a nozzle holding body 100 between them. The resist nozzle scan arm 92 is attached to an upper end portion of a vertical supporting member 96 movable on guide rails 94 laid in one direction (Y-direction) on the unit base plate 50 and moves in the Y-direction integrally with the vertical supporting member 96 by means of a Y-direction drive mechanism not illustrated.

The reflection-type photoelectric sensor 163 used for centering of the transfer device which will be described later can be attached to a side face of the nozzle holding body 100 of the resist nozzle scan arm 92.

The resist nozzle scan arm 92 is movable also in the X-direction perpendicular to the Y-direction so that the resist nozzle 86 is selectively fitted therewith at a resist nozzle waiting section 90, and moves also in the X-direction by means of an X-direction drive mechanism not illustrated.

A discharge port of the resist nozzle 86 is inserted in a port 90*a* of a solvent atmosphere chamber at the resist nozzle waiting section 90 and exposed to atmosphere of a solvent therein, whereby the resist solution at the forward end of the nozzle is not solidified and not deteriorated. Further, a plurality of resist nozzles 86 are provided, and from the choice of these nozzles, the appropriate one is chosen depending on the kind of resist solutions.

Attached to the forward end (the nozzle holding body 100) of the resist nozzle scan arm 92 is a thinner nozzle 101 for discharging a solution to wet the front surface of the wafer, for example, thinner to the front surface of the wafer prior to the discharge of the resist solution to the front surface of the wafer. The thinner nozzle 101 and the resist nozzle 86 are attached so that respective discharge ports are located on a line along the Y-direction of movement of the resist nozzle scan arm 92.

A vertical supporting member, like member 96, but movable in the Y-direction for supporting a rinse nozzle scan arm 120 as well as the vertical supporting member 96 for supporting the resist nozzle scan arm 92 is provided on the guide rails 95. A rinse nozzle 122 for side rinse is attached to the forward end portion of the rinse nozzle scan arm 120. The rinse nozzle scan arm 120 and the rinse nozzle 122 move translationally or rectilinearly between a rinse nozzle waiting position (position shown by a full line) set by the side of the cup CP and a rinse solution discharge position (position shown by a dotted line) set directly above the peripheral portion of the wafer W disposed on the spin chuck 52.

Next, the coating operation of the resist solution in the resist coating unit (COT) thus structured will be explained.

When being transferred to a position right above the cup CP inside the resist coating unit (COT) by means of the holding members 48 of the main wafer transfer mechanism 22, the wafer W is vacuum-sucked by the spin chuck 52 raised by the raising and lowering means 60, for example, composed of the air cylinder and the raising and lowering guide means 62. After the wafer W is vacuum-sucked by the spin chuck 52, the main wafer transfer mechanism 22 pulls back the holding members 48 from within the resist coating unit (COT), and thus the delivery of the wafer W to the resist coating unit (COT) is completed.

Subsequently, the spin chuck 52 is lowered until the wafer W reaches a home position in the cup CP, and then rotational drive of the spin chuck 52 is started by the drive motor 54.

Thereafter, movement of the nozzle holding body 100 from the resist nozzle waiting section 90 is started. The movement of the nozzle holding body 100 is performed along the Y-direction.

The discharge port of the thinner nozzle 101 reaches a position above the center of the spin chuck 52 (the center of the wafer W) at which point thinner is supplied to the front surface of the wafer W. The thinner supplied to the front surface of the wafer W is spread evenly from the center of the wafer W outwardly over the whole area of the wafer W by centrifugal force.

Subsequently, the nozzle holding body 100 moves in the Y-direction until the discharge port of the resist nozzle 86 reaches a position above the center of the wafer W. While the wafer W is being rotated at a predetermined rotational speed, the resist solution is dropped in the center of the front surface of the rotating wafer W from the discharge port of the resist nozzle 86 and spread from the center of the wafer W toward the periphery thereof by centrifugal force, thereby forming the resist film on the wafer W. In this case, the wafer W is rotated at a relatively high speed, for example, at not less than 3000 rpm in terms of a reduction in resist consumption.

After the dropping of the resist solution is completed, the rotational speed of the wafer W is reduced for a predetermined period of time if necessary to adjust film thickness. Thereafter, the rotational speed of the wafer W is increased, whereby the remaining resist solution is blown away and dried, thus forming a resist film with a predetermined thickness.

Thereafter, the nozzle holding body 100 is returned to a home position, and the back surface of the wafer W is back-rinsed by cleansing means not illustrated, and if necessary, the side edge portion of the wafer W is side-rinsed by cleaning means not illustrated. Thereafter, the rotational speed of the wafer W is increased, whereby the rinse solution for back rinse and side rinse is blown away and drained. Then, the rotation of the wafer W is stopped, and the coating process is completed.

Next, centering of the wafer transfer device for the coating unit (COT) will be explained with reference to FIG. 5, FIG. 8, and FIG. 9.

Figure 8:
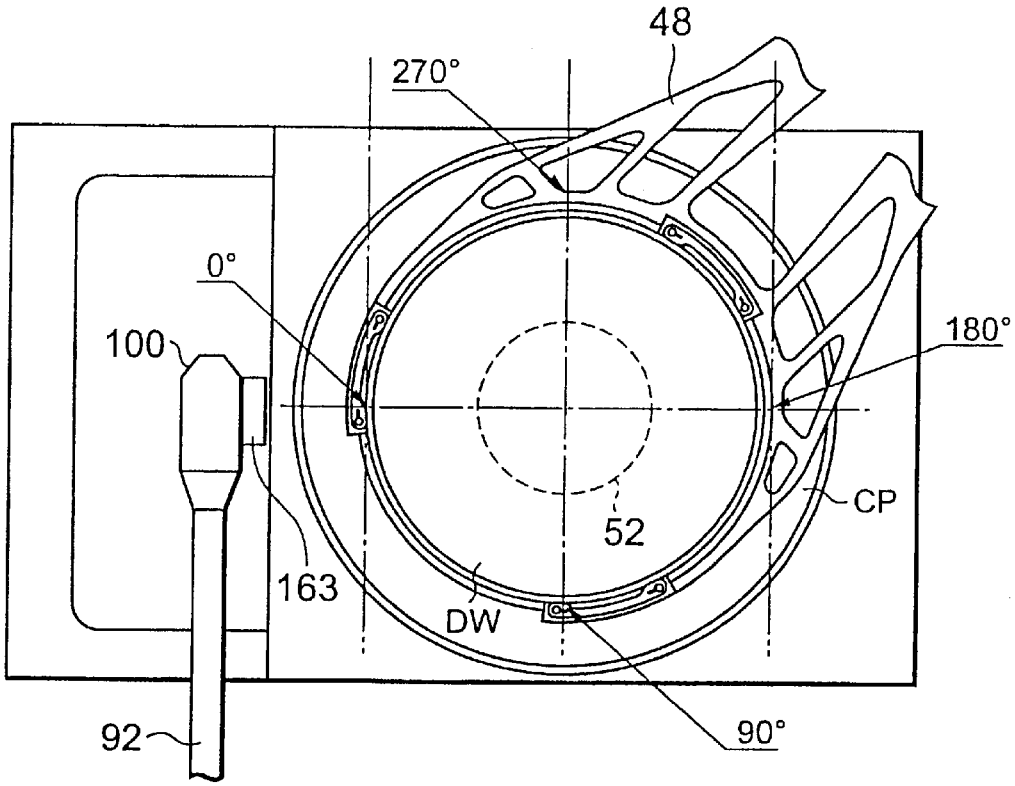
FIG. 8 is a partial plan view of the resist coating unit (COT)
Figure 9:
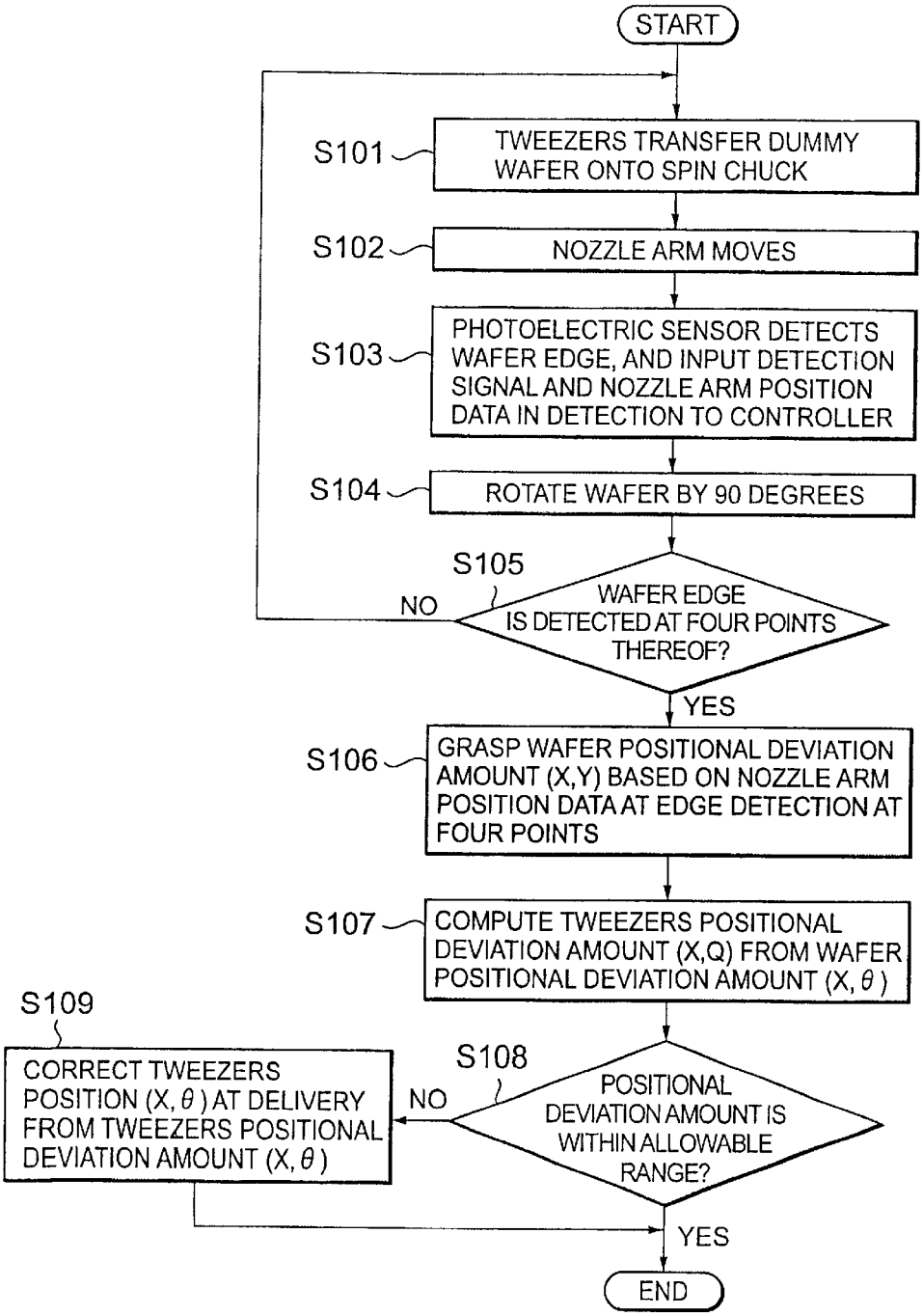
FIG. 9 is a flowchart showing operation for centering of a wafer transfer device for the resist coating unit (COT)

FIG. 8 is a partial plan view of the resist coating unit (COT), and FIG. 9 is a flowchart showing the operation for centering of the wafer transfer device for the coating unit (COT).

As shown in FIG. 8, the tweezers 48 of the wafer transfer device 46 moves to a position above the spin chuck 52 while the wafer W is mounted thereon, and then descends. The wafer W is vacuum-sucked by the spin chuck 52 when a clearance (Z-axis clearance) between the wafer W and the spin chuck 52 reaches a specified value.

The reflection type photoelectric sensor 163 is attached to the side face of the nozzle holding body 100 of the resist nozzle scan arm 92 (hereinafter referred to as the nozzle arm 92) as described above. The photoelectric sensor 163 is moved horizontally over a dummy wafer DW by the nozzle arm 92 to detect an edge of the dummy wafer DW, and a detection signal of the edge is inputted to the coating unit controller 151.

Moreover, the nozzle arm 92 is structured to move horizontally over the dummy wafer DW by means of a moving mechanism (not illustrated), and position data of the nozzle arm 92 are inputted to the coating unit controller 151 by means of the encoder 164 provided in the moving mechanism (not illustrated) of the nozzle arm 92.

Accordingly, the photoelectric sensor 163 is moved over the dummy wafer DW by the nozzle arm 92, and when it detects the edge of the dummy wafer DW at one point thereof, a detection signal (ON signal) of the edge is inputted from the photoelectric sensor 163 to the coating unit controller 151, and position data of the nozzle arm 92 at the time of this detection are inputted from the encoder 164 to the coating unit controller 151.

After the detection of the edge of the dummy wafer DW at one point thereof is completed, the dummy wafer DW is rotated by 90° each time as shown in FIG. 8, and the edge is detected each time by the photoelectric sensor 163. As a result, the edge is detected at the total of four points of 0°, 90°, 180°, and 270°. Incidentally, the edge may be detected at the total of two points of 0° and 180° by rotating the dummy wafer DW by 180° each time. Also, the edge may be detected at the total of three points of 0°, 120°, and 240° by rotating the dummy wafer DW by 120° each time.

When detection signals of the edge at these four points and position data of the nozzle arm 92 at the time of each detection are inputted to the coating unit controller 151, a positional deviation amount (X-axis, Y-axis) of the dummy wafer DW with respect to a delivery position on the spin chuck 52 is computed based on these signals and data, and thereafter correction data (X-axis, θ-axis) of the tweezers 48 are computed.

Next, a centering process of the wafer transfer device in the coating unit (COT) will be explained in accordance with the flowchart in FIG. 9.

First, the dummy wafer DW is transferred to a position above the spin chuck 52 by the tweezers 48 of the wafer transfer device 46 while being mounted on the tweezers 48, and then lowered. A clearance (Z-axis clearance) between the dummy wafer DW and the spin chuck 52 reaches a specified value at which point the dummy wafer DW is vacuum-sucked by the spin chuck 52 (step 101).

Subsequently, the nozzle arm 92 is moved horizontally over the dummy wafer DW (step 102). When the reflection-type photoelectric sensor 163 attached to the nozzle arm 92 detects the edge of the dummy wafer DW and makes an ON signal, a detection signal of the edge and position data of the nozzle arm 92 at the time of this detection are inputted to the coating unit controller 151 (step 103).

After the detection of the edge of the dummy wafer DW at one point thereof is completed, the dummy wafer DW is rotated by 90° as shown in FIG. 8. The edge is detected at 90°, 180°, and 270° in the same manner, and each edge detection signal and the position data of the nozzle arm 92 at the time of each detection are inputted to the coating unit controller 151 (step 104).

Subsequently, it is determined whether or not the detection of the edge at the total of four points is completed (step 105). When the detection is completed, the positional deviation amount (X, Y) of the dummy wafer DW with respect to the delivery position on the spin chuck 52 is computed in the system controller 150, based on each edge detection signal (ON signal) which is inputted and the position data of the nozzle arm 92 at the time of each detection (step 106).

Based on the above data of the positional deviation amount (X, Y) of the dummy wafer DW, a positional deviation amount (X, θ) of the tweezers 48 is computed in the system controller 150 (step 107).

When initial data exist in the system controller 150, the positional deviation amount (X, θ) of the tweezers 48 and the initial data are compared, whereby it is determined whether or not the positional deviation amount is within the allowable range of the initial data (step 108), and when the positional deviation amount exceeds the allowable range, the position of the tweezers 48 at the time of delivery is corrected based on the positional deviation amount (X, θ) (step 109). Consequently, the wafer W is accurately mounted at the delivery position on the spin chuck 52 by the tweezers 48. When the initial data do not exist (At the time of initialization), it is determined whether or not a positional deviation amount (X, θ) of the tweezers 48 is within the allowable range of a design value. When it is within the allowable range, the position of the tweezers 48 at the time of delivery is corrected so as to be a predetermined position based on the positional deviation amount (X, θ). When the positional deviation is not within the allowable range, resetting of the system is performed.

As described above, centering can be performed automatically without help of an operator, thus enabling prompt centering in the coating unit (COT).

It should be mentioned that centering data (X, θ) at the time of initialization is stored in the data memory 162 connected to (or contained in) the system controller 150 and can be utilized later.

Figure 10:
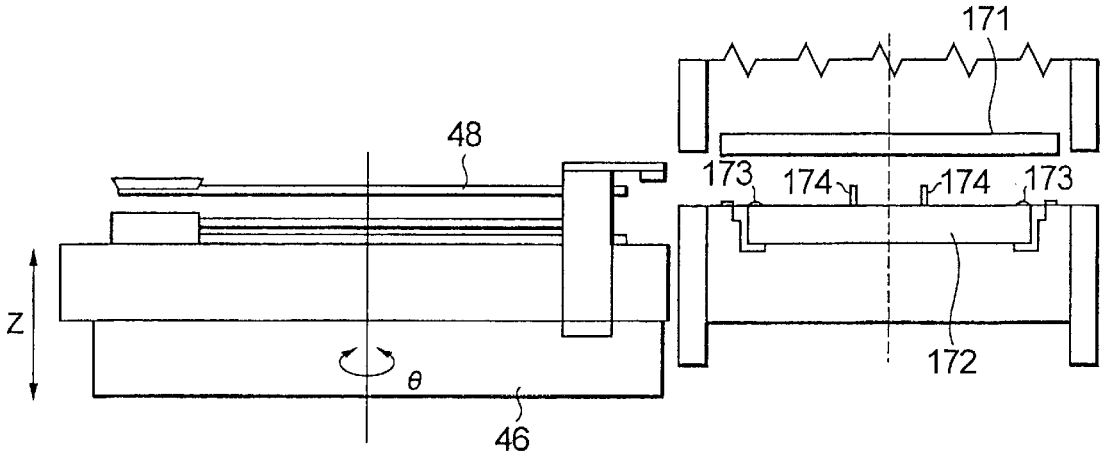
FIG. 10 is a schematic sectional view of a hot plate unit (HP)

Next, the hot plate unit (HP) will be explained with reference to FIG. 10. FIG. 10 is a schematic sectional view of the hot plate unit (HP).

The hot plate unit (HP) has a cover 171 which is ascendable and descendable, and a heating plate 172 for heating the wafer W is disposed with its surface being horizontal beneath the cover 171. A heater (not illustrated) is fitted in the heating plate 172 and can be set at a desired temperature.

A plurality of fixed pins (proximity pins) 173 are provided at the front surface of the heating plate 172, and the wafer W is held by these fixed pins 173 with a very small gap between the wafer W and the heating plate 172. Namely, a proximity method is adopted. Direct contact of the heating plate 172 and the wafer W is avoided, and the wafer W is heat-treated by radiation heat from the heating plate 172.

A plurality of (three) lift pins 174 are provided to be ascendable and descendable through a plurality of through-holes in the heating plate 172. A raising and lowering mechanism (not illustrated) is provided under the lift pins 174. The three lift pins 174 receive the wafer W from the tweezers 48 of the wafer transfer device 46 while being raised, and then they are lowered and the wafer W is mounted on the fixed pins 173.

In such a hot plate (HP), pre-bake processing at a predetermined temperature is performed for the wafer W coated with the resist solution, or post-exposure bake processing is performed for the exposed wafer W, and post-bake processing is performed for the developed wafer W.

Figure 11:
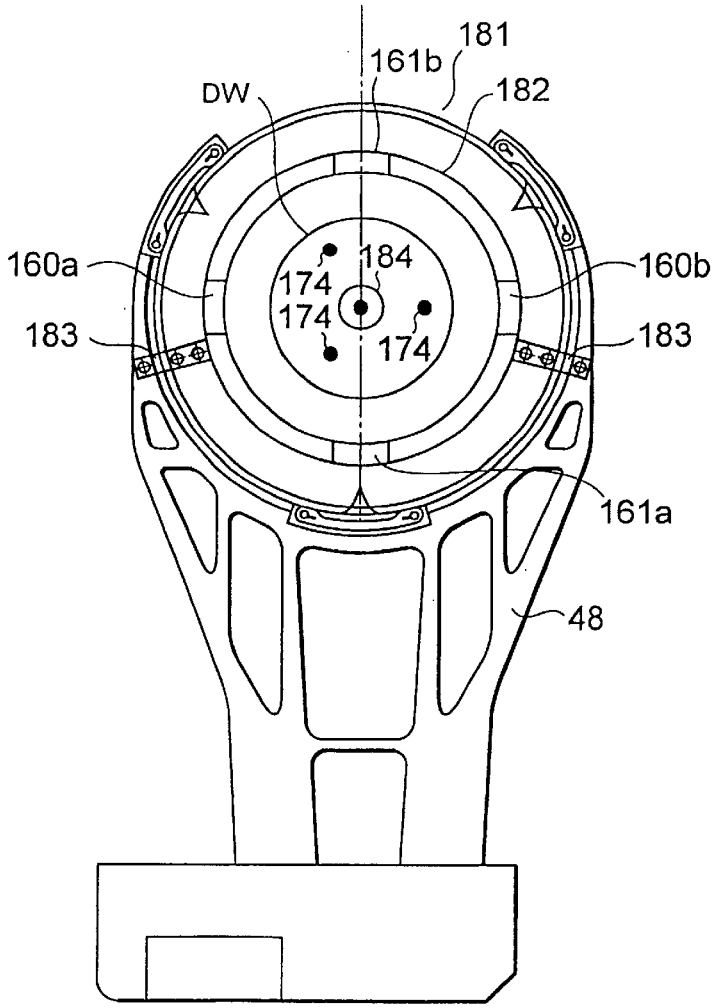
FIG. 11 is a partial plan view of the hot plate (HP) and tweezers of the wafer transfer device.
Figure 12A:
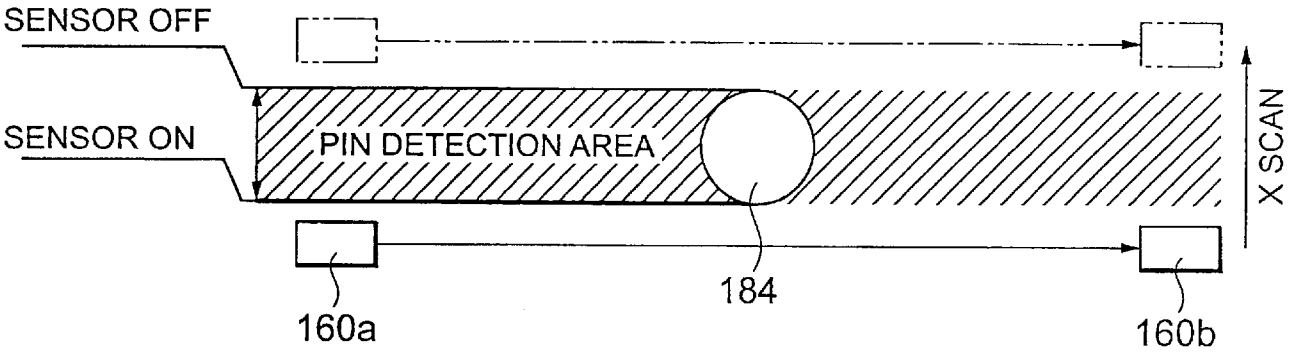
FIG. 12A is a schematic view showing a state in which a center pin on the hot plate (HP) is detected by a photoelectric sensor.
Figure 12B:
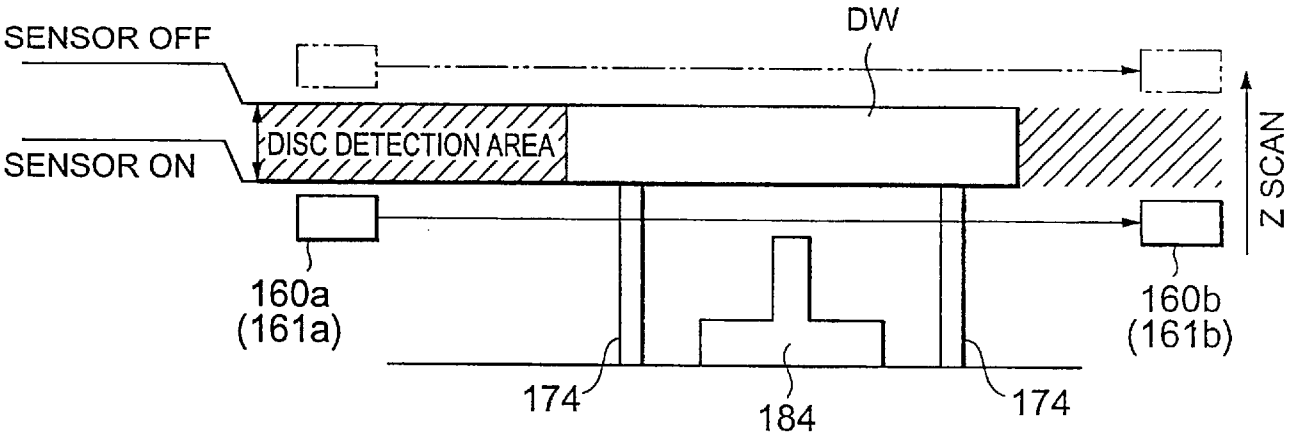
FIG. 12B is a schematic view showing a state in which the upper ends of lift pins on the hot plate (HP) are detected by the photoelectric sensor.
Figure 13:
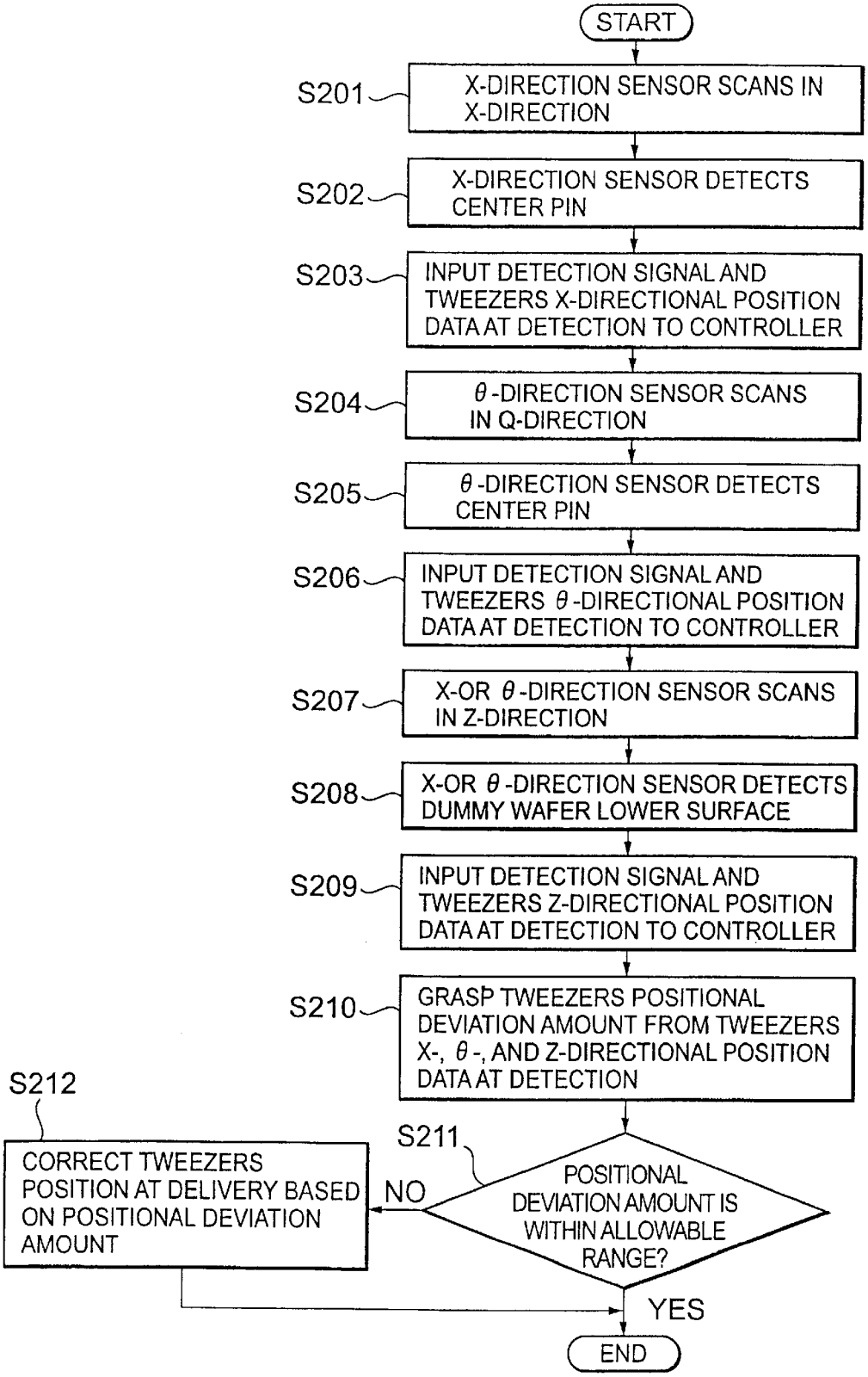
FIG. 13 is a flow chart showing operation for centering of the wafer transfer device for the hot plate unit (HP)

Next, centering of the wafer transfer device for the hot plate unit (HP) will be explained with reference to FIG. 5, FIG. 11, FIG. 12A, FIG. 12B and FIG. 13. FIG. 11 is a partial plan view of the hot plate (HP) and the tweezers of the wafer transfer device, FIG. 12A is a schematic view showing a state in which a center pin on the hot plate (HP) is detected by the photoelectric sensor, FIG. 12B is a schematic view showing a state in which the upper ends of the lift pins on the hot plate (HP) are detected by the photoelectric sensor, and FIG. 13 is a flow chart showing operation for centering of the wafer transfer device for the hot plate unit (HP).

As shown in FIG. 11, in centering, a centering instrument composed of an outer ring 181 and an inner ring 182 is fitted on a wafer mounting portion of the tweezers 48 of the wafer transfer device 46 by fitting members 183. A light emitting side X-direction sensor 160*a* and a light receiving side X-direction sensor 160*b* of the transmission-type photoelectric sensor are attached to the inner ring 182 at an angle of 180° so as to be opposite each other, and a light emitting side θ-direction sensor 161*a* and a light receiving side θ-direction sensor 161*b* of the transmission-type photoelectric sensor are attached to the inner ring 182 at an angle of 180° so as to be opposite each other.

A center through-hole (not illustrated) is provided in the center of the heating plate, and a center pin 184 for centering is inserted in the center through-hole (not illustrated).

The tweezers 48 deliver the wafer W to the upper ends of the raised three lift pins 174, and in more detail, a position at which the tweezers 48 deliver the wafer W finally is a position (delivery position) fixed by a center position of the heating plate 172 and upper end positions of the three lift pins 174.

Further, as described above, provided in the X-axis motor 154, the θ-axis motor 155, and the Z-axis motor 156 of the wafer transfer device 46 are the X-axis encoder 157, the θ-axis encoder 158, and the Z-axis encoder 159 for feeding back the amount of rotation of each motor (that is, the amount of movement of the tweezers 48 and the amounts of rotation and movement of the transfer device 46 itself) to the transfer device controller 153.

Accordingly, as shown in FIG. 12A, when the light emitting side X-direction sensor 160*a* scans in the X-direction while emitting light to the light receiving side X-direction sensor 160*b* and detects the center pin 184, a detection signal (ON signal) is inputted from the X-direction sensor 160 to the transfer device controller 153, and X-directional position data of the tweezers 48 at this time are inputted from the X-axis encoder 157 to the transfer device controller 153.

Although not especially illustrated, when the light emitting side θ-direction sensor 161*a* scans in the θ-direction while emitting light to the light receiving side θ-direction sensor 161*b* and detects the center pin 184, a detection signal (ON signal) is inputted from the θ-direction sensor 161 to the system controller 150 via the transfer device controller 153, and θ-directional position data of the tweezers 48 at this time are inputted from the θ-axis encoder 158 to the system controller 150 via the transfer device controller 153.

Further, as shown in FIG. 12B, the dummy wafer DW is mounted on the upper ends of the three lift pins 174, and when the light emitting side X-direction sensor 160*a* (or the θ-direction sensor 161*a*) scans in the Z-direction while emitting light to the light receiving side X-direction sensor 160*b* (or the θ-direction sensor 161*b*) and detects the lower surface of the dummy wafer DW (that is, the upper ends of the lift pins), a detection signal (ON signal) is inputted to the system controller 150, and Z-directional position data of the tweezers 48 at this time are inputted from the Z-axis encoder 159 to the system controller 150 via the transfer device controller 153.

Next, a centering process of the wafer transfer device in the hot plate unit (HP) will be explained in accordance with the flowchart in FIG. 13.

As shown in FIG. 12A, the light emitting side X-direction sensor 160*a* scans in the X-direction while emitting light to the light receiving side X-direction sensor 160*b* (step 201).

When the X-direction sensor 160 detects the center pin 184 (step 202), a detection signal (ON signal) is inputted from the X-direction sensor 160 to the transfer device controller 153, and X-directional position data of the tweezers 48 at this time are inputted from the X-axis encoder 157 to the transfer device controller 153 (step 203).

Subsequently, the light emitting side θ-direction sensor 161*a* scans in the θ-direction while emitting light to the light receiving side θ-direction sensor 161*b* (step 204). When the θ-direction sensor 161 detects the center pin 184 (step 205), a detection signal (ON signal) is inputted from the θ-direction sensor 161 to the transfer device controller 153, and θ-directional position data of the tweezers 48 at this time are inputted from the θ-axis encoder 158 to the transfer device controller 153 (step 206).

Thereafter, as shown in FIG. 12B, the dummy wafer DW is mounted on the upper ends of the three lift pins 174, and when the light emitting side X-direction sensor 160*a* (or the θ-direction sensor 161*a*) scans in the Z-direction while emitting light to the light receiving side X-direction sensor 160*b* (or the θ-direction sensor 161*b*) (step 207).

When the lower surface of the dummy wafer DW (that is, the upper ends of the lift pins) is thus detected (step 208), a detection signal (ON signal) is inputted to the transfer device controller 153, and Z-directional position data of the tweezers 48 at this time are inputted from the Z-axis encoder 159 to the transfer device controller 153 (step 209).

In the transfer device controller 153, a positional deviation amount is grasped from the position data in the X-, Y-, and θ-directions of the tweezers 48 when the center pin 184 and the lower surface of the dummy wafer DW are detected (step 210).

When initial data exist in the system controller 150, the positional deviation amount (X, θ) of the tweezers 48 and the initial data are compared, whereby it is determined whether or not the positional deviation amount is within the allowable range of the initial data (step 211), and when the positional deviation amount exceeds the allowable range, the position of the tweezers 48 at the time of delivery is corrected based on the positional deviation amount (step 212). Consequently, the wafer W is accurately mounted at the delivery position fixed by the center position of the heating plate 172 and the upper end positions of the three lift pins 174 by means of the tweezers 48. When the initial data do not exist (At the time of initialization), it is determined whether or not the positional deviation amount (X, θ) of the tweezers 48 is within the allowable range of a design value. When it is within the allowable range, the position of the tweezers 48 at the time of delivery is corrected so as to be a predetermined position based on the positional deviation amount (X, θ). When the positional deviation amount is not within the allowable range, resetting of the system is performed.

As described above, centering can be performed automatically without help of the operator, thus enabling prompt centering for the hot plate unit (COT).

It should be mentioned that centering data (X, θ, Z) at the time of initialization is stored in the data memory 162 connected to (or contained in) the system controller 150 and can be utilized later.

Figure 14:
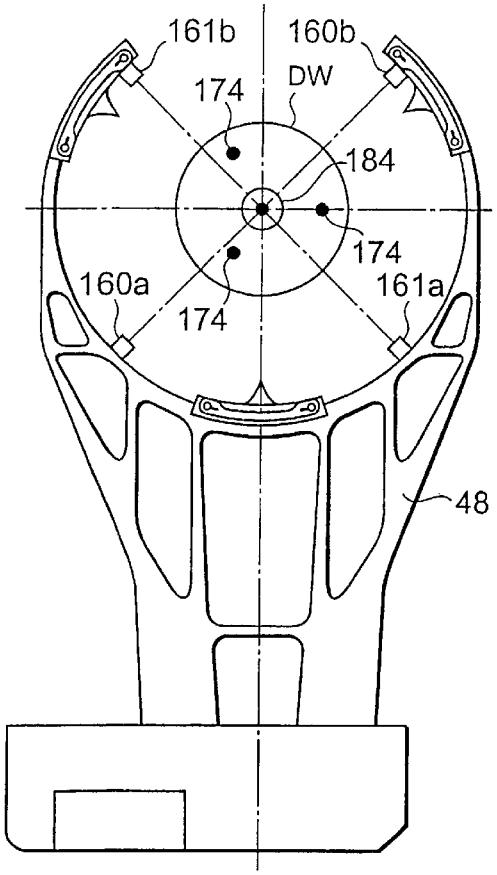
FIG. 14 is a partial plan view of the hot plate (HP) and the tweezers of the wafer transfer device for explaining another example of a transfer device centering method.

Next, another example of a transfer device centering method for the hot plate unit (HP) will be explained with reference to FIG. 14. FIG. 14 is a partial plan view of the hot plate (HP) and the tweezers of the wafer transfer device for explaining another example of the transfer device centering method.

In this example, differently from the aforesaid example, the centering instrument is not used, and the transmission-type photoelectric sensor is directly attached to the tweezers 48 of the wafer transfer device 46. In other words, the light emitting side X-direction sensor 160*a* and the light receiving side X-direction sensor 160*b* of the transmission-type photoelectric sensor are attached at a wafer mounting portion of the tweezers 48 of the wafer transfer device 46 at an angle of 180° so as to be opposite each other, and the light emitting side θ-direction sensor 161*a* and the light receiving side θ-direction sensor 161*b* of the transmission-type photoelectric sensor are attached at an angle of 180° so as to be opposite each other.

In the above case, similarly to the aforesaid embodiment, the center pin 184 and the lower surface of the dummy wafer DW are detected by the light emitting side X-direction sensor 160*a,* the light receiving side X-direction sensor 160*b* , the light emitting side θ-direction sensor 161*a,* and the light receiving side θ-direction sensor 161*b,* and the X-, θ-, and Z-directional position data of the tweezers 48 at the time of this detection are computed, and a positional deviation value (X, θ, Z) of the tweezers 48 is computed based on the above position data, and the position of the tweezers 48 at the time of delivery of a substrate is corrected.

It should be mentioned that the aforesaid tweezers to which the photoelectric sensor is attached may be provided in the wafer transfer device 46 separately from the tweezers 48 for transferring the wafer W.

Figure 15A:
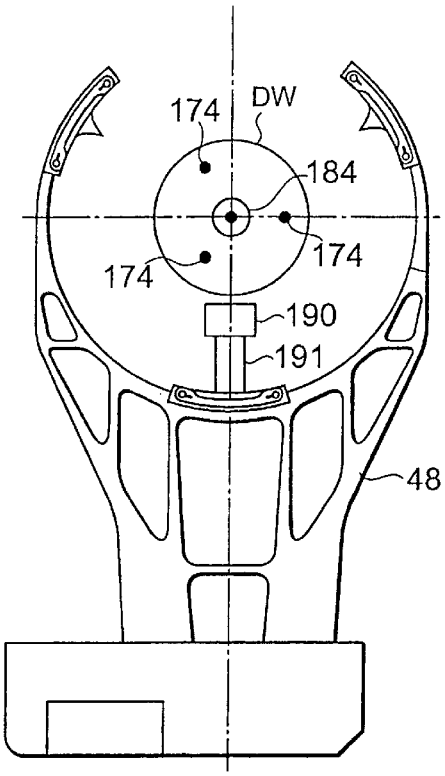
FIG. 15A is a partial plan view of the hot plate (HP) and the tweezers of the wafer transfer device for explaining still another example of the wafer transfer device centering method.
Figure 15B:
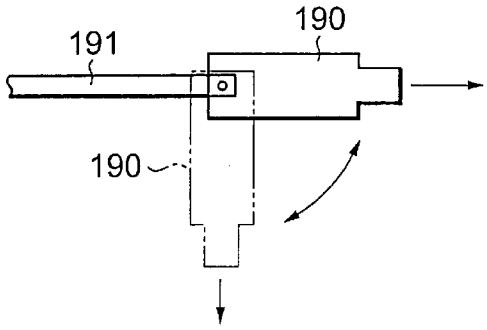
FIG. 15B is a partial side view of FIG. 15A.

Next, still another example of the wafer transfer device centering method for the hot plate unit (HP) will be explained with reference to FIG. 15A and FIG. 15B. FIG. 15A is a partial plan view of the hot plate (HP) and the tweezers of the wafer transfer device for explaining still another example of the wafer transfer device centering method, and FIG. 15B is a partial side view showing a portion of a CCD camera in FIG. 15A.

In this example, the CCD camera is used in place of the transmission-type photoelectric sensor. Specifically, the CCD camera 190 is fitted to be swingable within an angle of 90° in the vertical direction so as to be trained horizontally and downward, to a supporting member 191 extended from the base end side of the wafer mounting portion of the tweezers 48.

When the CCD camera 190 is trained downward, the center pin 184 (or the center through-hole of the heating plate 172) is photographed from above, and an X-θ plane is processed as picture data, whereby the X- and θ-directional position data of the center pin 184 are computed.

When the CCD camera 190 is trained horizontally, the lower surface of the dummy wafer DW on the raised three lift pins 174 is photographed from the side thereof, and a θ-Z plane is processed as picture data, whereby the Z-directional position data of the lower surface of the dummy wafer DW on the lift pins 174 are computed.

A positional deviation value (X, θ, Z) of the tweezers 48 is computed based on the X- and θ-directional positional data of the center pin 184 and the position data of the lower surface of the dummy wafer DW on the lift pins 174, and thus the position of the tweezers 48 at the time of delivery of the substrate is corrected.

It should be mentioned that the aforesaid tweezers to which the CCD camera is attached may be provided in the wafer transfer device 46 separately from the tweezers 48 for transferring the wafer W.

Figure 16:
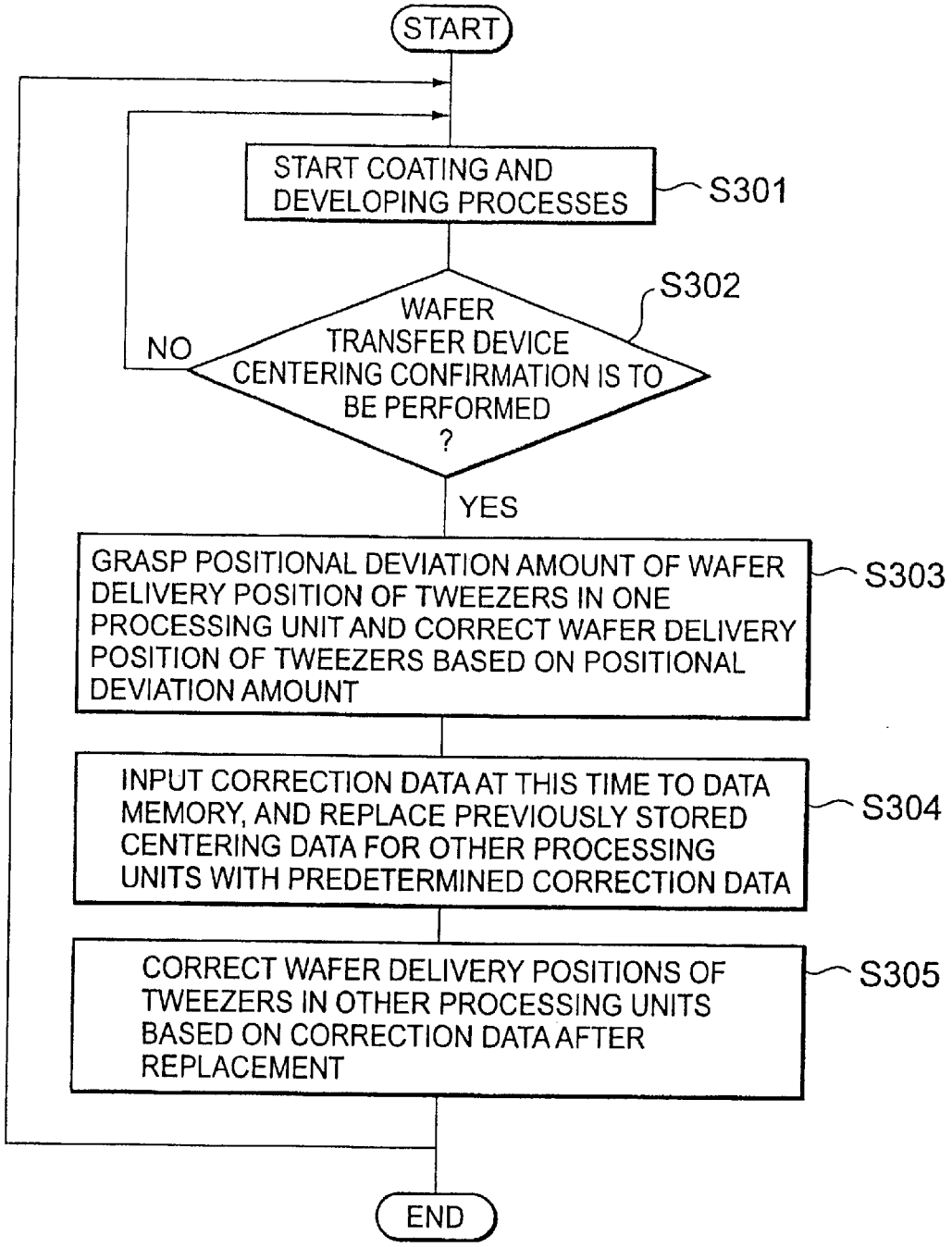
FIG. 16 is a flowchart of a case where centering of the wafer transfer device is performed during a processing process by the coating and developing system.

Next, a case where centering of the wafer transfer device is performed during processing processes in the coating and developing system will be explained with reference to FIG. 5 and FIG. 16. FIG. 16 is a flowchart of a case where confirmation of centering of the wafer transfer device is made during the processing processes in the coating and developing system. Incidentally, the following flow is controlled by the system controller 150.

As shown in FIG. 5, the data memory 162 is connected to the system controller 150. In this data memory 162, for example, centering data of the wafer transfer device 46 for the coating unit (COT) are stored, and centering data of the wafer transfer device 46 for the hot plate unit (HP) are stored. As described above, the coating unit (COT) in which the wafer W is fixed on the spin chuck and the hot plate unit (HP) in which the wafer W is fixed on the non-rotational heating plate have different centering methods and different centering data, whereby the relationship of the different centering data is stored in the position data memory 162.

A case where centering of the wafer transfer device 46 for respective processing units is regularly or irregularly carried out during the processing processes in the coating and developing system after centering of the wafer transfer device 46 at the time of initialization is completed will be explained along the flow chart in FIG. 16.

First, processing processes in the coating and developing system are started (step 301), and it is determined whether or not centering of the wafer transfer device 46 for the respective processing units is to be carried out in predetermined timing during the processing processes (step 302). When the confirmation of centering is performed, a positional deviation amount of a position at which the tweezers 48 deliver the wafer W in one processing unit, for example, the coating unit (COT) is grasped, and the position of the tweezers 48 at the time of delivery of the wafer W is corrected based on the above positional deviation amount (step 303).

In other words, a positional deviation amount (X, θ) of the tweezers 48 is obtained during the processing processes and positional deviation when the tweezers 48 deliver the wafer W can be confirmed and corrected based on the positional deviation amount (X, θ).

Thereafter, correction data (X, θ) at this time are inputted to the position data memory 162, and centering data of the tweezers 48 for respective processing units stored previously in the position data memory 162 are replaced with predetermined correction data (X, θ) (step 304). When the other processing units perform centering different from centering of one unit which is performing centering, for example, when one processing unit which is performing centering is the coating unit (COT) and one of the other processing units is the hot plate unit (HP), the centering data can be corrected in the same manner since the relationship of the centering data of these units is already stored in the data memory 162 as described above.

Subsequently, the position correction data (X, θ) after replacement are outputted from the position data memory 162, and a position at which the tweezers 48 deliver the substrate in other processing units, for example, the hot plate unit (HP) is corrected based on the position correction data (step 305).

As described above, not only among units having the same detecting method of centering but also among units having different detecting methods of centering, if correction data for one processing unit can be obtained, only correction of already stored centering data needs to be performed based on this correction data in the other processing units. Hence, if centering for one processing unit is performed, centering for other plurality of processing units is considered to be performed similarly. As a result, centering of the tweezers 48 of the transfer device 46 for the plurality of processing units can be performed in a very short time.

In the aforesaid example, correction in the hot plate unit (HP) is performed based on the correction data obtained by centering in the coating unit (COT). Contrary to this, correction in the coating unit (COT) may be performed based on correction data obtained by centering in the hot plate (HP). Further, correction operation may be performed by receiving and sending correction data among the processing units of the same kind.

Figure 17:
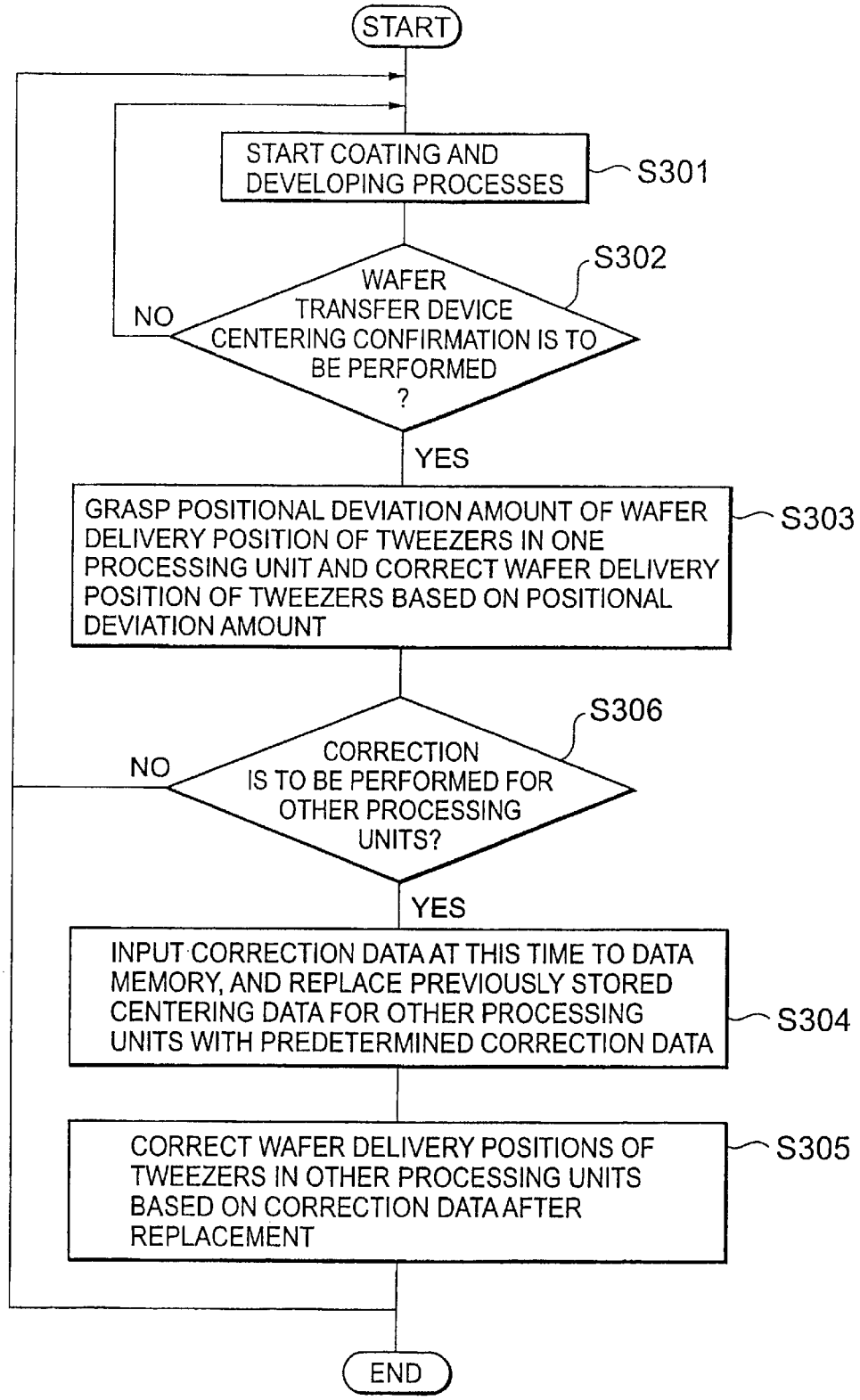
FIG. 17 is a flowchart of another example of the case where centering of the wafer transfer device is performed during the processing process by the coating and developing system.

As shown in FIG. 17, as to position correction regarding other processing units except a processing unit in which position correction is performed, such a structure that a user is made to determine prior to step 304 whether or not steps after step 304 are performed (step 306) is also suitable. Thereby, when positional deviation is apparently caused by a problem peculiar to the processing unit in which the position correction is performed, it can be avoided that unnecessary positional deviation occurs in other processing units.

Figure 18:
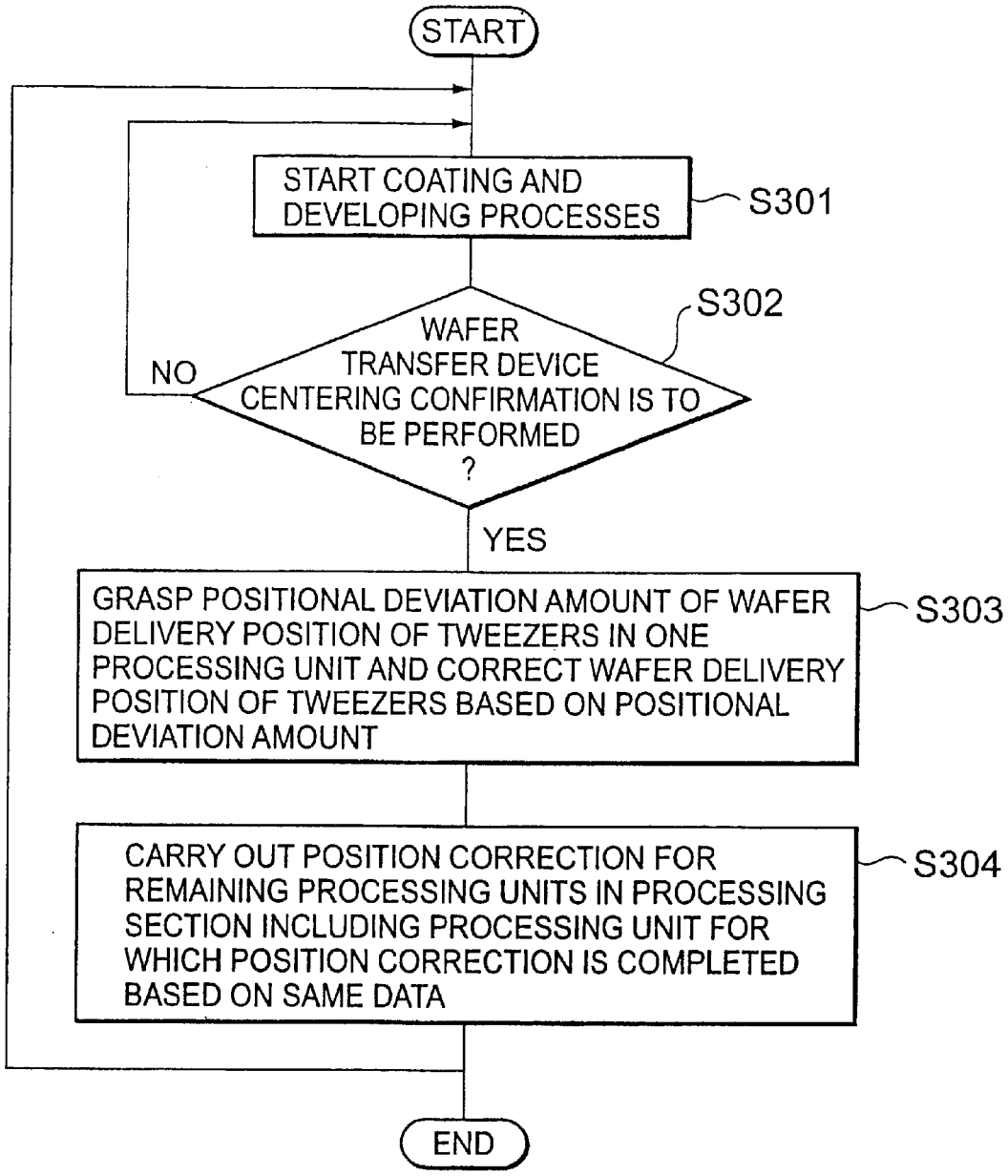
FIG. 18 is a flowchart of still another example of the case where centering of the wafer transfer device is performed during the processing process by the coating and developing system.

Especially in a so-called vertical transfer-type processing system shown in FIG. 1 to FIG. 3, each of processing sections $G_1$, $G_2$, $G_3$, and $G_4$ has processing units in the vertical direction. Respective processing units in one processing section can be adjusted so that the wafer W is mounted flatly at the same position among the vertical processing units. In such a case, as shown in FIG. 18, with respect to the X-direction or the θ-direction, when position correction for one processing unit is performed in one processing section (step 303), position correction for all the processing units of the processing section in which the processing unit for which the position correction is performed is included, for example, may be performed based on the same data (step 304'). When position correction with respect to the X-direction or the θ-direction is performed for the cooling unit (COL) of the third processing section $G_3$, position correction for the remaining adhesion unit (AD), alignment unit (ALIM), extension unit (EXT), and four hot plate units (HP) may be performed based on the same data.

In the aforesaid embodiment, centering of the wafer transfer device is performed regularly or irregularly, for example. Irregular centering is performed by such a irregular centering mode being set by the user, for example. When a transfer error occurs, for example, centering mode may be automatically carried out with the occurrence of the transfer error as a trigger.

The detection of the transfer error can be performed by considering that the wafer W falls in some place in a drive system and thus the drive system is blocked, for example, when abnormal load arises in the drive system in the system.

Figure 19:
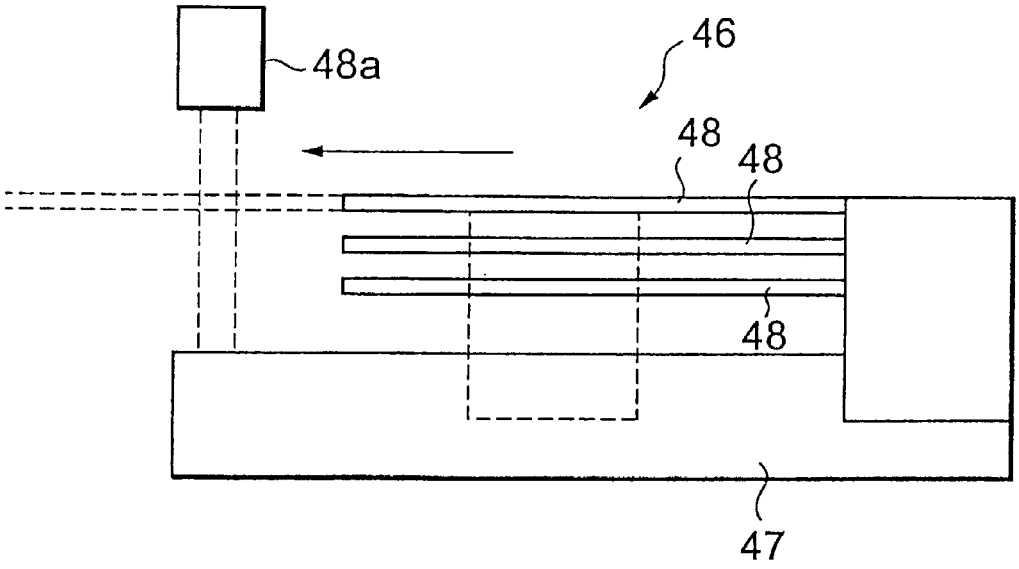
FIG. 19 is a schematic view of a main wafer transfer mechanism according to another embodiment of the present invention.

Further, the detection of the transfer error can be performed by considering that the wafer W falls, for example, when it is detected that the wafer W does not exist on the holding members 48 for holding the wafer W. The above detection can be made by disposing, for example, a reflection-type photoelectric sensor 48*a* for confirming the presence or absence of the wafer W and the position thereof above and in front of the holding members 48 of the main wafer transfer mechanism 22 as shown in FIG. 19 and sticking out the holding member 48 at the upper tier to be detected, for example, out of the holding members 48 disposed at three tiers forward to confirm the presence or absence of the wafer W by means of the photoelectric sensor 48*a*. According to the aforesaid structure, the same detection as above can be performed also with respect to the holding members 48 at the middle tier and the lower tier. Positional deviation can be also detected in the same manner, and such a structure that centering mode is automatically carried out when the positional deviation amount exceeds a predetermined amount is also suitable.

It should be mentioned that the present invention is not limited to the aforesaid embodiments, and various changes can be made therein. For example, in the aforesaid embodiments, with the coating unit (COT) as an example of a processing unit having a rotary stage and the hot plate unit (HP) as an example of a processing unit having a fixed stage, the case where centering of the transfer device is performed in these units is explained. The present invention, however, is not limited to the aforesaid case. The developing unit (DEV) which is one of other spinner-type units may be used as the processing unit having the rotary stage, and one of other thermal processing units such as the cooling unit (COL), the adhesion unit (AD), and the like may be used as the processing unit having the fixed stage. Further, the case where the present invention is applied to the coating and developing system for the semiconductor wafer is shown in the aforesaid embodiments, but the present invention is not limited to this system. The present invention can be applied to any case where a substrate is mounted on a stage in a processing unit by means of a transfer device. As for the substrate, other substrates to be processed in addition to the semiconductor wafer, for example, an LCD substrate is also suitable.

As described above, according to the present invention, a substrate is transferred onto a mounting table in a processing unit by means of a transfer device, a positional deviation amount of the substrate with respect to a delivery position on the mounting table is detected by detecting means, a positional deviation amount of a position at which the transfer device delivers the substrate is computed based on a detection value of the positional deviation amount of the substrate, and the position at which the transfer device delivers the substrate is corrected by the obtained positional deviation amount of the transfer device, whereby centering can be performed automatically without help of the operator, thus enabling prompt centering of the transfer device, for example, at the time of initialization of the processing unit.

Further, according to the present invention, while detecting means is being moved over a processing plate by the transfer device, a center position of the processing plate and upper end positions of a plurality of lift pins which are raised are detected by the detecting means, thereafter a positional deviation amount of a position at which the transfer device delivers the substrate is grasped based on detection values of the center position and upper end positions, and then the position at which the transfer device delivers the substrate is corrected based on the positional deviation amount of the transfer device. Accordingly, centering can be performed automatically without help of the operator, thus enabling prompt centering especially at the time of initialization of the thermal processing unit and the like.

Furthermore, according to the present invention, a positional deviation amount of a position at which the transfer device delivers the substrate in one processing unit is grasped in predetermined timing, the position at which the transfer device delivers the substrate is corrected based on this positional deviation amount, correction data at this time is inputted to storage means, based on this correction data, centering data for respective processing units which are already stored in the storage means are replaced with predetermined correction data, and based on the correction data after replacement, a position at which the transfer device delivers the substrate in each of the other processing units is corrected. Therefore, if correction data for one processing unit can be obtained, only correction of already stored centering data needs to be performed based on this correction data in the other processing units. As a result, centering of the transfer device for a plurality of processing units can be performed in a very short time. Moreover, by grasping the relationship between centering data in a first processing unit and centering data in a second processing unit, if correction data for one processing unit can be obtained, only correction of already stored centering data needs to be performed based on this correction data in another processing unit even if centering is performed in different methods in the first and second processing units. Besides, a dummy is used as the substrate in the aforesaid embodiment, but a real substrate is also suitable.

The aforesaid embodiments have the intention of clarifying technical meaning of the present invention. Therefore, the present invention is not intended to be limited to the above concrete embodiments and to be interpreted in a narrow sense, and various changes may be made therein without departing from the spirit of the present invention and within the meaning of the claims.

What is claimed is:

1. A transfer device centering method for centering at least one holding member of a transfer device so that the transfer device transfers a substrate to a predetermined delivery position with the holding member in each of processing units in a substrate processing apparatus comprising a plurality of processing units each for performing predetermined processing for the substrate and the transfer device for carrying the substrate into/out of each of the processing units, comprising:

a step of previously performing centering of position at which the transfer device delivers the substrate in each processing unit and storing this centering data in storage means;

a first correcting step of ascertaining a positional deviation amount of a position at which the transfer device delivers the substrate in one processing unit and correcting the position at which the transfer device delivers the substrate based on the positional deviation amount;

a replacing step of inputting correction data at this time to the storage means, and based on this correction data, replacing the centering data for each processing unit already stored in the storage means with predetermined correction data; and a second correcting step of correcting positions at which the transfer device delivers the substrate in the other processing units based on the correction data after replacement.

2. The method as set forth in claim 1, wherein the transfer device delivers the substrate onto a rotatable mounting table with the holding member, and wherein the positional deviation amount of the substrate with respect to the delivery position on the mounting table is optically detected while the mounting table is being rotated in said detecting step.

3. The method as set forth in claim 2, wherein a moving member moving across the substrate on the mounting table and an optical sensor attached to the moving member for detecting an edge of the substrate are provided, and wherein the positional deviation amount of the substrate with respect to the delivery position on the mounting table is detected by the optical sensor in said first correcting step.

4. The method as set forth in claim 3:

wherein said first correcting step comprises:

a step of detecting the edge of the substrate at one point thereof by the optical sensor while moving the optical sensor horizontally by means of the moving member, after this detection, rotating the substrate by a predetermined angle by means of the mounting table to detect the edge of substrate at another point thereof by the sensor, and thereafter repeating the rotation of the substrate and the detection of the edge of the substrate to detect the edge of substrate at a plurality of points thereof; and a step of obtaining position data of the moving member when the optical sensor detects the edge of the substrate at the plurality of points thereof, and ascertaining a positional deviation amount of the substrate based on the position data of the moving member.

5. The method as set forth in claim 1, wherein the predetermined delivery position is specified by a center position of a processing plate and upper end positions of a plurality of lift pins which are raised in the substrate processing apparatus comprising at least a processing unit which has the processing plate with the plurality of lift pins, moves the substrate between a mounting position and a transfer position by means of the lift pins, and performs predetermined processing for the substrate at the mounting position and the transfer device for carrying the substrate into/out of the processing unit, comprising:

a detecting step of optically detecting the center position of the processing plate and the upper end positions of the plurality of raised lift pins relative to the transfer device by means of optical detecting means while moving the optical detecting means provided above the processing plate over the processing plate by the transfer device;

a step of ascertaining a positional deviation amount of a position at which the transfer device delivers the substrate based on the detection values of the center position and the upper end positions; and a correcting step of correcting the position at which the transfer device delivers the substrate based on the positional deviation amount of the transfer device.

6. The method as set forth in claim 5, wherein the optical detecting means has an optical sensor, attached to a substrate supporting member of the transfer device directly or via an instrument, for optically detecting the center position of the processing plate and the upper end positions of the plurality of raised lift pins relative to the transfer device.

7. The method as set forth in claim 6, wherein said optically detecting step comprises:

a step of optically detecting the center position of the processing plate by the optical detecting means while moving the optical sensor horizontally over the processing plate by means of the substrate supporting member of the transfer device and computing center position data; and a step of optically detecting the upper end positions of the plurality of raised lift pins relative to the transfer device by the optical detecting means while moving the optical sensor vertically above the processing plate by means of the substrate supporting member and computing upper end position data.

8. The method as set forth in claim 5, wherein the optical detecting means has photographing means, attached to a substrate supporting member of the transfer device, for detecting the center position of the processing plate and the upper end positions of the plurality of raised lift pins relative to the transfer device, and wherein said optically detecting step comprises:

a step of optically detecting the center position of the processing plate by the photographing means while moving the photographing means horizontally over the processing plate by means of the substrate supporting member of the transfer device and computing center position data; and a step of optically detecting the upper end positions of the plurality of raised lift pins relative to the transfer device by the photographing means while moving the photographing means vertically above the processing plate by means of the substrate supporting member and computing upper end position data.

9. The method as set forth in claim 1, further comprising:

a step of confirming whether or not said replacing step and said second correcting step are to be performed.

10. A transfer device centering method for centering at least one holding member of a transfer device so that the transfer device transfers a substrate to a predetermined delivery position in each of processing units in a substrate processing apparatus comprising a plurality of processing units which are vertically tiered each for performing predetermined processing for the substrate and the transfer device for carrying the substrate into/out of each of the processing units, comprising:

a step of ascertaining a positional deviation amount of a position at which the transfer device delivers the substrate in any one of the processing units and correcting the position at which the transfer device delivers the substrate based on the positional deviation amount; and a step of correcting a position at which the transfer device delivers the substrate in each of the remaining processing units based on the positional deviation amount.

11. The method as set forth in claim 10, wherein the positional deviation amount relates to positional deviation in a horizontal direction.

12. A transfer device centering method for centering at least one holding member of a transfer device so that the transfer device transfers a substrate to a predetermined delivery position with the holding member in each of processing units in a substrate processing apparatus comprising at least one first processing unit for performing predetermined processing for the substrate mounted on a rotatable mounting table, at least one second processing unit which has a processing plate with a plurality of lift pins, moves the substrate between a mounting position and a transfer position by means of the lift pins, and performs predetermined processing for the substrate at the mounting position, and the transfer device for carrying the substrate into/out of the first and second processing units, comprising:

a step of previously performing centering of positions at which the transfer device delivers the substrate in methods different from each other in the first and second processing units and storing these centering data in storage means;

a step of previously ascertaining a relationship between the centering data in the first processing unit and the centering data in the second processing unit and storing the relationship in the storage means;

a first correcting step of ascertaining a positional deviation amount of a position at which the transfer device delivers the substrate in either one of the first processing unit or the second processing unit and correcting the position at which the transfer device delivers the substrate based on the positional deviation amount;

a replacing step of inputting correction data at his time to the storage means and based on this correction data and the relationship between the centering data in the first processing unit and the centering data in the second processing unit, replacing centering data for the other processing units previously stored in the storage means with predetermined correction data; and a second correcting step of correcting positions at which the transfer device delivers the substrate in the other processing units based on the correction data after replacement for the other processing units.

13. The method as set forth in claim 12, further comprising:

a step of confirming whether or not said replacing step and said second correcting step are to be performed.

14. A substrate processing apparatus for performing predetermined processing for a substrate, comprising:

a plurality of processing units each for performing predetermined processing for the substrate;

a transfer device for transferring the substrate to a predetermined delivery position in each of the processing units; and centering means for obtaining correction data for correcting a position at which the transfer device delivers the substrate in each processing unit, and based on the correction data, correcting the position at which the transfer device delivers the substrate, and wherein said centering means comprising:

storage means in which centering data for each processing unit are stored; and controlling means for ascertaining a positional deviation amount of a position at which the transfer device delivers the substrate in one unit, correcting the position at which the transfer device delivers the substrate based on the positional deviation amount, inputting correction data at this time to the storage means, based on this correction data, replacing the centering data for each processing unit already stored in the storage means with predetermined correction data, and based on the correction data after replacement, correcting positions at which the transfer device delivers the substrate in the other processing units.

15. A substrate processing apparatus for performing predetermined processing for a substrate, comprising:

at least one first processing unit for performing predetermined processing for the substrate mounted on a rotatable mounting table; at least one second processing unit which has a processing plate with a plurality of lift pins, moves the substrate between a mounting position and a transfer position by means of the lift pins, and performs predetermined processing for the substrate at the mounting positions;

a transfer device for transferring the substrate to/from a predetermined delivery position in each of the first and second processing units; and centering means for obtaining correction data for correcting a position at which the transfer device delivers the substrate in each of the processing units, and based on the correction data, correcting the position at which the transfer device delivers the substrate, and wherein said centering means comprising:

storage means in which centering data when centering of positions at which the transfer device delivers the substrate is performed in methods different from each other in the first processing unit and the second processing unit and a relationship between the centering data in the first processing unit and the centering data in the second processing unit are stored; and controlling means for ascertaining a positional deviation amount of a position at which the transfer device delivers the substrate in either one of the first processing unit or the second processing unit, correcting the position at which the transfer device delivers the substrate based on the positional deviation amount, inputting correction data at this time to the storage means, based on this correction data the relationship between the centering data in the first processing unit and the centering data in the second processing unit stored in the storage means, replacing the centering data for each processing unit already stored in the storage means with predetermined correction data, and based on the correction data after replacement, correcting positions at which the transfer device delivers the substrate in the other processing units.

16. The apparatus as set forth in claim 15, wherein the first processing unit is a coating unit for coating the substrate with a coating solution, and the second processing unit is a thermal processing unit for performing thermal processing for the substrate.

* * * * *